US005740661A

United States Patent [19]

Yamaguchi et al.

[11] Patent Number: 5,740,661

[45] Date of Patent: Apr. 21, 1998

[54] METHOD AND APPARATUS OF PRODUCING SHEET WRAPPING BODY

[75] Inventors: Takayuki Yamaguchi, Niihama; Takanori Kume, Ichihara; Yasuhiro Kayano; Tomio Higuchi, both of Niigata, all of Japan

[73] Assignees: Sumitomo Chemical Company, Limited, Osaka; Sanjo Machine Works Ltd., Niigata, both of Japan

[21] Appl. No.: 651,612

[22] Filed: May 22, 1996

[30] Foreign Application Priority Data

May 23, 1995 [JP] Japan ..... 7-124109

[51] Int. Cl.[6] ..... B65B 9/02

[52] U.S. Cl. ..... 53/553; 53/513; 53/520

[58] Field of Search ..... 53/450, 520, 463, 53/553, 513; 156/269, 308.4, 522, 552; 271/276, 277

[56] References Cited

U.S. PATENT DOCUMENTS

| | | | |
|---|---|---|---|
| 2,232,783 | 2/1941 | Hausheer | 53/450 |
| 3,096,977 | 7/1963 | Winkler et al. | 271/276 |
| 3,140,572 | 7/1964 | Peterson et al. | 53/450 |
| 3,336,028 | 8/1967 | Schonmeier | 271/276 |
| 3,902,407 | 9/1975 | Trosdorff | 271/276 |
| 4,769,175 | 9/1988 | Inoue . | |
| 4,841,712 | 6/1989 | Roou | 53/412 |
| 4,888,078 | 12/1989 | Instance | 156/269 |
| 4,894,106 | 1/1990 | Instance | 156/269 |
| 5,104,116 | 4/1992 | Pohjola | 271/276 |
| 5,356,397 | 10/1994 | Storandt | 604/292 |
| 5,584,163 | 12/1996 | Storandt | 53/450 |

FOREIGN PATENT DOCUMENTS

| | | |
|---|---|---|
| 0 320 814 | 6/1989 | European Pat. Off. . |
| 27 04 350 | 8/1977 | Germany . |
| 40 41 743 A1 | 6/1992 | Germany . |
| 55-116436 | 9/1980 | Japan . |
| 62-234544 | 10/1987 | Japan . |
| 1066963 | 4/1967 | United Kingdom . |

OTHER PUBLICATIONS

Catalog C51 (IMA North America, Inc.).
Catalog C56 (IMA North America, Inc.).

*Primary Examiner*—James F. Coan
*Assistant Examiner*—Gene L. Kim
*Attorney, Agent, or Firm*—Sughrue, Mion, Zinn, Macpeak & Seas, PLLC

[57] ABSTRACT

In a sheet wrapping body producing apparatus, an oxygen absorbing strip sheet supplied from an oxygen absorbing sheet supplying shaft is cut out by a first rotary die cut unit to make an oxygen absorbing sheet tip. The tip is transported in such a manner to prevent the misalignment by a delivery drum unit and a first transportation belt unit. During the transportation, a breathing layer strip sheet is supplied on a transporting surface of the first transportation belt unit, on which the oxygen absorbing sheet tip is placed. Also, a strip cover film is placed on the oxygen absorbing sheet tip. Then, a rotary seal unit seals the breathing layer strip sheet and strip cover film, and the sealed portion is cut by a second rotary die cut unit. Accordingly, a sheet wrapping body can be produced at high speeds.

8 Claims, 15 Drawing Sheets

METHOD AND APPARATUS OF PRODUCING SHEET WRAPPING BODY

FIELD OF THE INVENTION

The present invention relates to a method and apparatus of producing a sheet wrapping body wrapping a sheet material, such as an oxygen absorbing sheet.

BACKGROUND OF THE INVENTION

Wrapping materials for sealing foods or the like airtight contain an oxygen absorbing agent to keep the contents fresh. In case that powders or particles of the oxygen absorbing agent are used, the agent is sealed in a small package. However, besides the fact that the package is bulky, the agent comes out from the package and mixes with the foods if the sealing is not tight enough, or a lump of the agent in the package is set on the surface and remains inactive inside, causing serious damages.

A sheet of oxygen absorbing agent, generally called as an oxygen absorbing sheet, is known as a solution of the above problems. An example oxygen absorbing sheet is disclosed in Japanese Laid-open Patent Application Nos. 55-116436 (1980) and 62-234544 (1987), and the sheet is wrapped up in a small package made of a coating sheet.

An oxygen absorbing sheet wrapped up in a coating sheet, or sheet wrapping body, is produced by an apparatus different from those used for producing a package filled with powders or particles of the oxygen absorbing agent. An example apparatus of producing such a sheet wrapping body is disclosed in above-mentioned Japanese Laid-open Patent Application No. 55-116436. More specifically, a sheet material subject to wrapping is cut out from a strip of a sheet by a cut blade moving up and down, then the sheet material is sealed as being wrapped up in coating sheets supplied from above and underneath, and then the sealed portion is cut out by another cut blade moving up and down.

According to the above structure, however, both the cut means for cutting out the sheet material from the strip sheet and for cutting out the sheet wrapping body from the coating sheets are respectively cut blades moving up and down. This limits streamlining the production, and for this reason, the above structure is not preferable to mass-produce the sheet wrapping bodies.

SUMMARY OF THE INVENTION

It is therefore an object of the present invention to provide a method and apparatus of mass producing sheet wrapping bodies at high speeds.

To fulfill the above object, a sheet wrapping body producing apparatus of the present invention is characterized by having:

a supply unit of a sheet material subject to wrapping;

a first cut unit;

a transportation unit;

a bottom coating material supply unit;

a top coating material supply unit;

a seal unit; and a second cut unit, wherein, the supply unit of a sheet material subject to wrapping supplies a strip of a sheet material subject to wrapping to the first cut unit, the first cut unit cuts out sheet tips subject to wrapping from the strip of the sheet material subject to wrapping using a first pair of rotating roller, the transportation unit transports the sheet tips subject to wrapping made by the first cut unit onto a bottom coating material while holding each sheet tip subject to wrapping not to cause misalignment, the bottom coating material supply unit supplies a strip of the bottom coating material onto a transportation surface of the transportation unit, and transports the bottom coating material to a farther position by way of the seal unit and the second cut unit, the top coating material supply unit supplies a strip of a top coating material onto the sheet tips subject to wrapping placed on the bottom coating material, and transports the top coating material to a farther position by way of the seal unit and second cut unit, the seal unit is provided in a stage following of the transportation unit, and seals the top coating material and the bottom coating material to wrap up the sheet tips subject to wrapping individually using a second pair of rotating rollers, and the second cut unit cuts the top coating material and the bottom coating material in a sealed portion made by the seal unit using a third pair of rotating rollers, and produces sheet wrapping bodies each respectively wrapping the sheet tip subject to wrapping.

According to the above structure, the sheet material subject to wrapping supplied from its supply unit is cut out by the first pair of rotating rollers of the first cut unit and the cut-out portions are made into the sheet tips subject to wrapping. The sheet tips subject to wrapping are transported while being held in such a manner not to cause misalignment. On the other hand, a strip of the bottom coating material is supplied onto the transportation surface from the bottom coating material supply unit, and the sheet tips subject to wrapping are sequentially placed on the bottom coating material. Then, a strip of the top coating material is supplied on the sheet tips subject to wrapping from the top coating material supply unit. Thus, the sheet tips subject to wrapping are sandwiched by the bottom coating material and top coating material, and transported further to the seal unit to the second cut unit in such a manner not to cause misalignment. Then, the bottom coating material and top coating material are sealed by the seal unit to wrap up each sheet tip subject to wrapping, and the sealed portion is cut by the third pair of rotating rollers of the second cut unit to produce the sheet wrapping bodies each respectively wrapping the sheet tip subject to wrapping.

As has been explained, the sheet tips subject to wrapping are cut out from the sheet material subject to wrapping by the first cut unit, the top coating material and bottom coating material are sealed while wrapping up the sheet tips subject to wrapping, and the sheet wrapping bodies are cut out from the sealed sheet. Since each of the above three units comprises a pair of rotating rollers, the above actions can be carried out in succession at high speeds.

Also, to ensure such a successive and fast operation, the sheet tips subject to wrapping are transported from the first cut unit by the transportation unit while being held in such a manner not to cause alignment. In addition, the sheet tips subject to wrapping sandwiched by the top coating material and bottom coating material are transported forward without causing misalignment together with both the top coating material and bottom coating material. As a result, the sheet wrapping bodies can be produced at high speeds.

Also, to fulfill the above object, a method of producing a sheet wrapping body of the present invention is characterized by having the steps of:

cutting out sheet tips subject to wrapping from a strip of a sheet material subject to wrapping using a first pair of rotating rollers;

transporting said sheet tips subject to wrapping onto a strip of a bottom coating material while holding each sheet tip subject to wrapping not to cause misalignment;

supplying a strip of a top coating material onto the sheet tips subject to wrapping provided on the bottom coating material;

sealing the top coating material and the bottom coating material to wrap up the sheet tips subject to wrapping individually using a second pair of rotating rollers; and producing sheet wrapping bodies each respectively wrapping the sheet tip subject to wrapping by cutting the top coating material and the bottom coating material in a sealed portion made in the sealing step using a third pair of rotating rollers.

According to the above method, the sheet tips subject to wrapping are cut out from the sheet material subject to wrapping by the first cut unit, the top coating material and bottom coating material are sealed while wrapping up the sheet tips subject to wrapping individually, and the sheet wrapping bodies are cut out from the sealed portion. Since each of the above three units comprises a pair of rotating rollers, the above actions can be carried out in succession at high speeds, thereby making it possible to produce the sheet wrapping bodies at high speeds.

For a fuller understanding of the nature and advantages of the invention, reference should be made to the ensuing detailed description taken in conjunction with the accompanying drawings.

DESCRIPTION OF THE EMBODIMENTS

(First Embodiment)

Referring to FIGS. 1 through 10, the following description will describe an example embodiment of the present invention.

Figure 1:
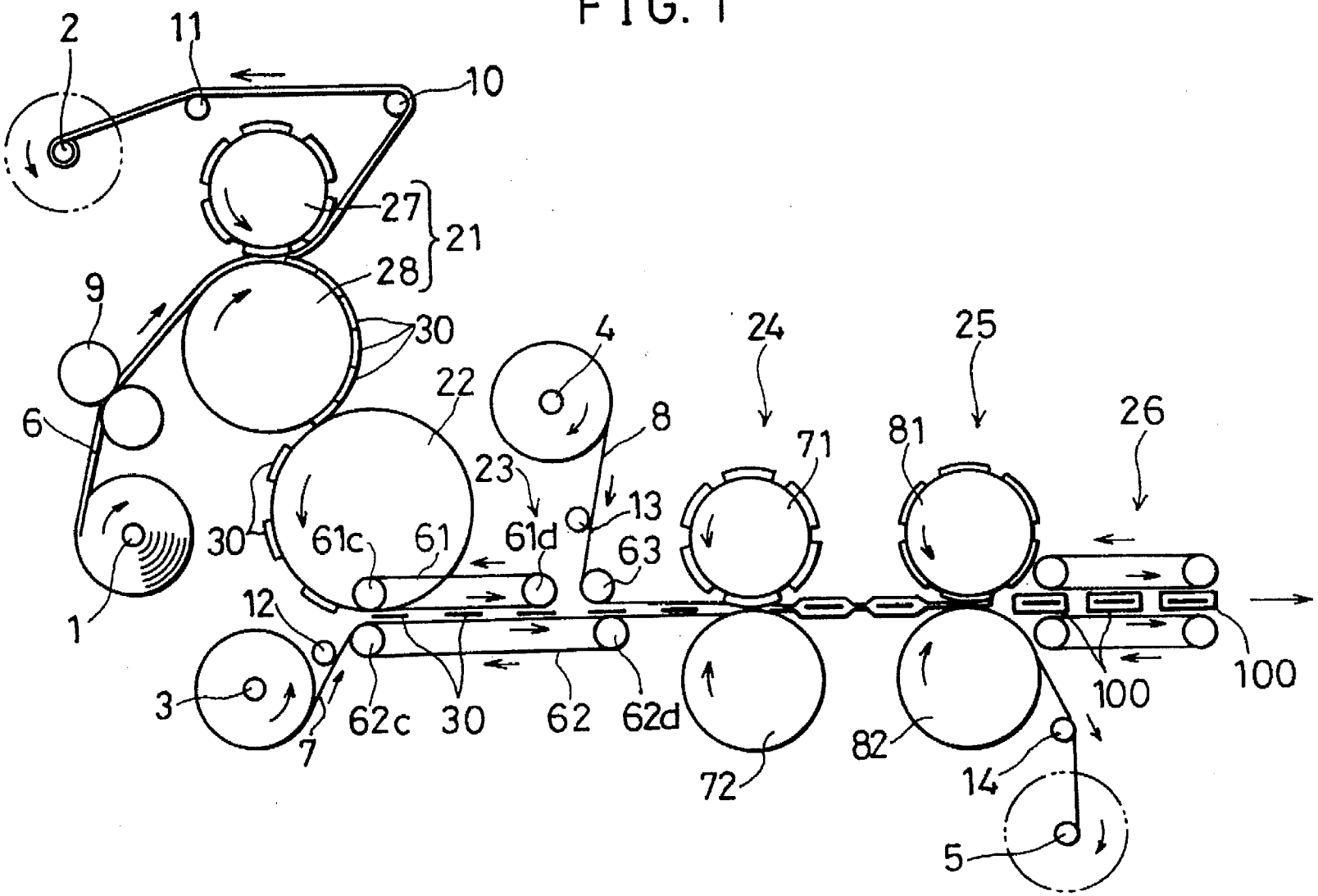
FIG. 1 is a schematic view showing the entire structure of a sheet wrapping body producing apparatus in accordance with an example embodiment of the present invention.

A sheet wrapping body producing apparatus in accordance with the present embodiment produces an oxygen absorbing sheet wrapping body. As shown in FIG. 1, the sheet wrapping body producing apparatus includes an oxygen absorbing sheet supply shaft 1, a used oxygen absorbing sheet take-up shaft 2, a breathing layer sheet supply shaft 3, a cover film supply shaft 4, and a used coating sheet take-up shaft 5. Note that the oxygen absorbing sheet supply shaft 1 and used oxygen absorbing sheet take-up shaft 2 form a supply unit of a sheet subject to wrapping; the breathing layer sheet supply shaft 3 and used coating sheet take-up shaft 5 form a bottom coating material supply unit; and the cover film supply shaft 4 and used coating sheet take-up shaft 5 form a top coating material supply unit. Each shaft is driven by unillustrated driving means in the direction indicated by an arrow.

The oxygen absorbing sheet supply shaft 1, breathing layer sheet supply shaft 3, and cover film supply shaft 4 respectively hold a roll of oxygen absorbing strip sheet 6 (sheet material subject to wrapping), a roll of breathing layer strip sheet 7 (bottom coating material), and a roll of strip cover film 8 (top coating material). The oxygen absorbing strip sheet 6 is supplied from the oxygen absorbing sheet supply shaft 1 by way of a nip roller 9, and reeled up by the used oxygen absorbing sheet take-up shaft 2 by way of guide rollers 10 and 11. The breathing layer strip sheet 7 is supplied from the breathing layer sheet supply shaft 3 by way of a guide roller 12, while the strip cover film 8 is supplied from the cover film supply shaft 4 by way of a guide roller 13. Both the breathing layer strip sheet 7 and strip cover film 8 are reeled up by the used covering sheet take-up shaft 5 by way of a guide roller 14.

The oxygen absorbing strip sheet 6 referred herein is, for example, a strip sheet of a kneaded product of iron-based oxygen absorbing agent powders and a resin material. Incidentally, commercially available oxygen absorbing sheets or oxygen absorbing sheet wrapping bodies include two types depending on the use thereof: a moisture depending type and a self-reacting type. The former absorbs oxygens in the presence of moisture, and examples of which are disclosed in Japanese Laid-open Patent Application Nos. 5-237380 (1993) and 5-318574 (1993). The latter comprises a moisture-dependent oxygen absorbing sheet and a hydrous water supply sheet laminated to the oxygen absorbing sheet so that it withholds moisture, and an example of which is disclosed in Japanese Laid-open Patent Application No. 2-203937 (1990). The sheet wrapping body producing apparatus of the present embodiment produces sheet wrapping bodies of the moisture depending type.

The breathing layer strip sheet 7 renders ventilation to enable the oxygen absorbing sheet (sheet material subject to wrapping), to absorb oxygens under normal use. In contrast, the strip cover film 8 renders no ventilation. All of the oxygen absorbing strip sheet 6, breathing layer strip sheet 7, and strip cover film 8 of the present embodiment are 100 mm wide.

The sheet wrapping body producing apparatus of the present embodiment further includes a first rotary die cut unit 21 (a first cut unit), a delivery drum unit 22 (second attracting roller), a first transportation belt unit 23, a rotary seal unit 24 (a seal unit), a second rotary die cut unit 25 (a second cut unit), and a second transportation belt unit 26. The components 21 through 26 are lined up sequentially. Note that the delivery drum unit 22 and first transportation belt unit 23 form a transportation unit.

The first rotary die cut unit 21 includes a cut roller 27 and an anvil roller 28 (first attracting roller), which are slightly spaced apart and oppose each other vertically. The first rotary die cut unit 21 cuts out oxygen absorbing sheet tips 30 (sheet tips subject to wrapping) from the oxygen absorbing sheet 6 supplied through a space between the two rollers 27 and 28 as they rotate. The first rotary die cut unit 21 functions in a known manner as is disclosed, for example, in Japanese Examined Patent Publication Nos. 52-20718 (1977), 6-57373 (1994), and 6-41070 (1994). However, the first rotary die cut unit 21 further includes the mechanism described below.

The first rotary die cut unit 21 cuts out 50-mm-dia oxygen absorbing sheet tips 30 from the oxygen absorbing strip sheet 6 continuously in a direction in which the first rotary die cut unit 21 rotates without leaving any unwanted space between every two adjacent oxygen absorbing sheet tips 30.

Figure 2:
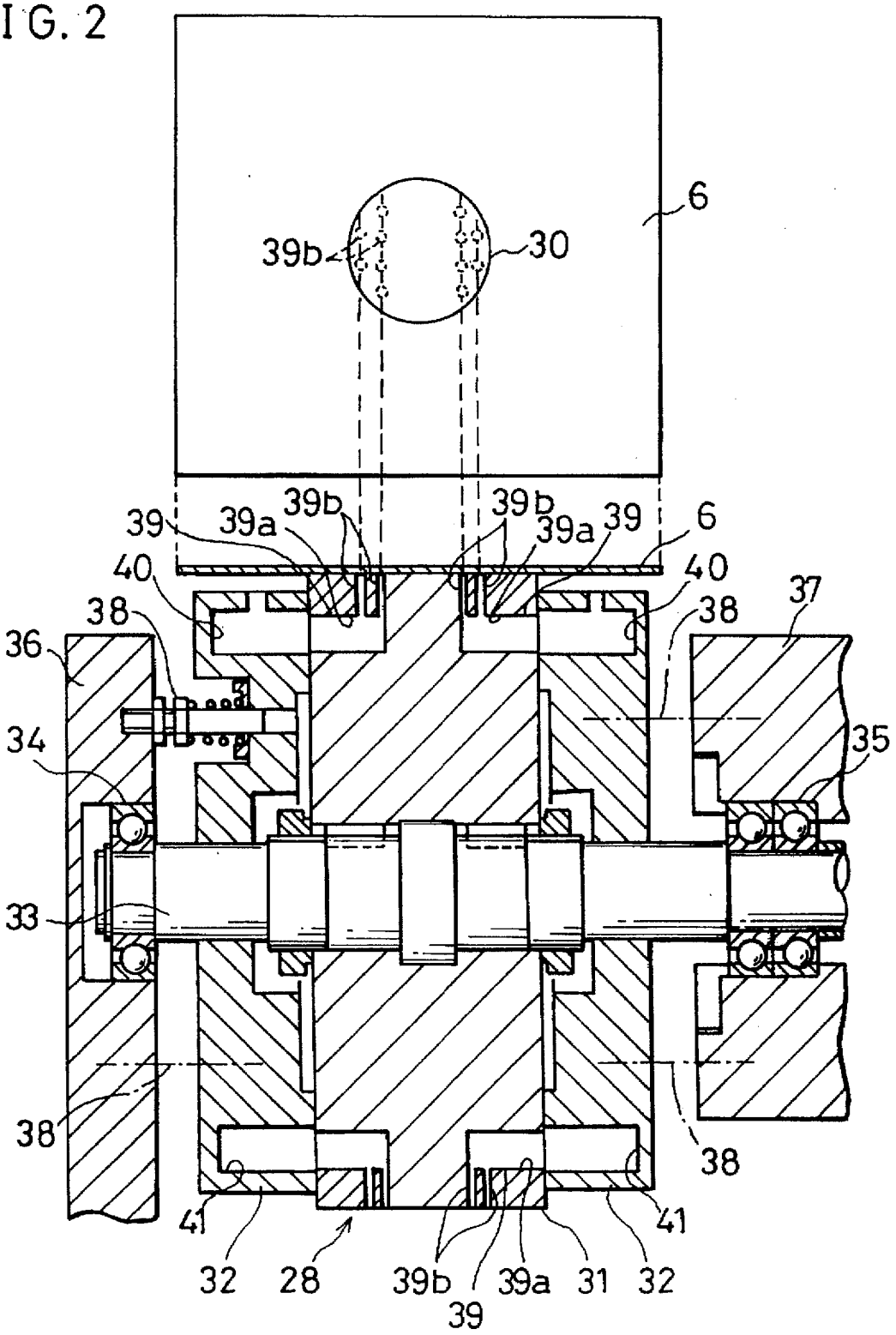
FIG. 2 is a longitudinal section of an anvil roller of FIG. 1.

As shown in FIG. 2, the anvil roller 28 includes a rotating drum section 31 and two blow ring sections 32 provided to the two opposing sides of the rotating drum section 31, respectively. The rotating drum section 31 is attached to a rotational axis 33 driven by unillustrated driving means. The rotational axis 33 is supported by fixing members 36 and 37 through bearings 34 and 35 at the both ends, respectively. A plurality of connecting members 38 are provided respectively between the fixing members 36 and 37 and the two blow ring sections 32 to disallow both the blow ring sections 32 to rotate.

Figure 3:
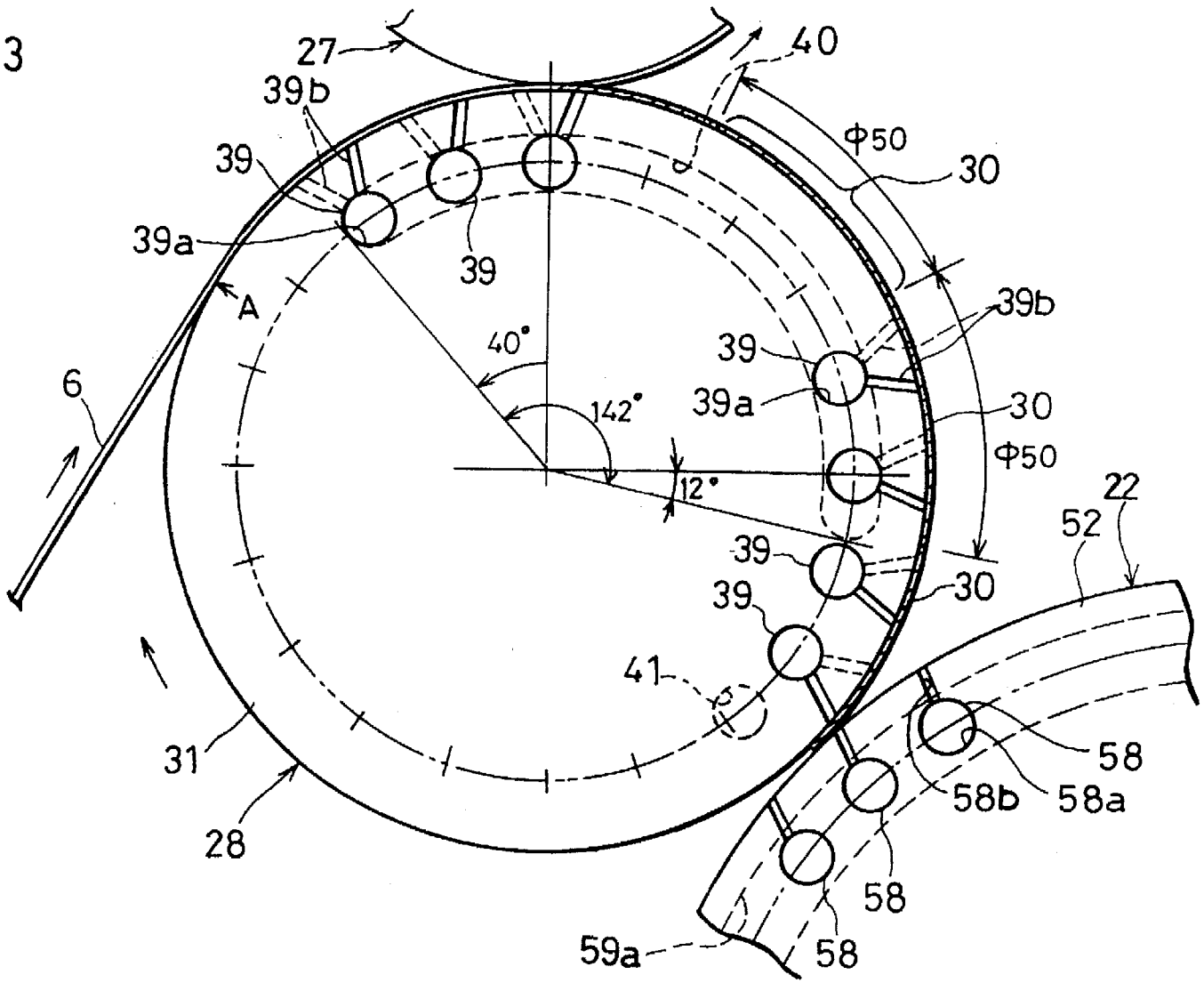
FIG. 3 is a schematic front view showing a structure around a rotating drum of the anvil roller of FIG. 2.

The rotating drum section 31 includes a plurality of separate suction sections 39. The suction sections 39 are formed in two columns along the circumference of the rotating drum section 31 at regular pitches. Each suction section 39 comprises a circular hole portion **39*a* and two nozzle portions 39*b*. The circular hole portion 39*a* extends toward the inside of the rotating drum section 31 from the side surface thereof. The nozzel portions 39*b* are holes extending from the circular hole portion 39*a* to the outer surface of the rotating drum section 31, whose diameters are smaller than that of the circular hole portion 39*a*. As shown in FIG. 3, the two nozzle portions 39*b* are made through in a V-shape if seen from the side surface of the rotating drum section 31. As shown in FIG. 2, the opening of each nozzle portion 39*b* across the outer surface of the rotating drum section 31 is located within the diameter of the oxygen absorbing sheet tip 30 transported forward by the rotating drum section 31** at the center across the outer surface thereof.

Each blow ring section 32 includes a negative pressure area setting groove 40 (negative pressure supply path to the suction sections 39) and a positive pressure supply hole 41 (positive pressure supply path to a single suction section 39). The negative pressure area setting groove 40 is connected to an unillustrated air vacuuming unit, while the positive pressure supply hole 41 is connected to an unillustrated air supplying unit. Both the negative pressure area setting groove 40 and positive pressure supply hole 41 extend from the side surface near the rotating drum section 31 side toward the other side surface. As shown in FIG. 3, the negative pressure area setting groove 40 extends in a direction in which the anvil roller 28 rotates at an angle of approximately 142 degrees from a point slightly ahead of the contacting point A where the anvil roller 28 touches the oxygen absorbing strip sheet 6. Thus, the outer surface of the anvil roller 28 over the negative pressure area setting groove 40 develops an attracting force.

The positive pressure supply hole 41 is a circular hole and connected to the circular hole portion **39*a* of one suction section 39 alone. As shown in FIG. 3, the positive pressure supply hole 41 is positioned at the lower stream with respect to a direction in which the rotating drum unit 31 rotates from the center of an area where the delivery drum unit 22 and rotating drum unit 31** oppose each other.

Figure 4:
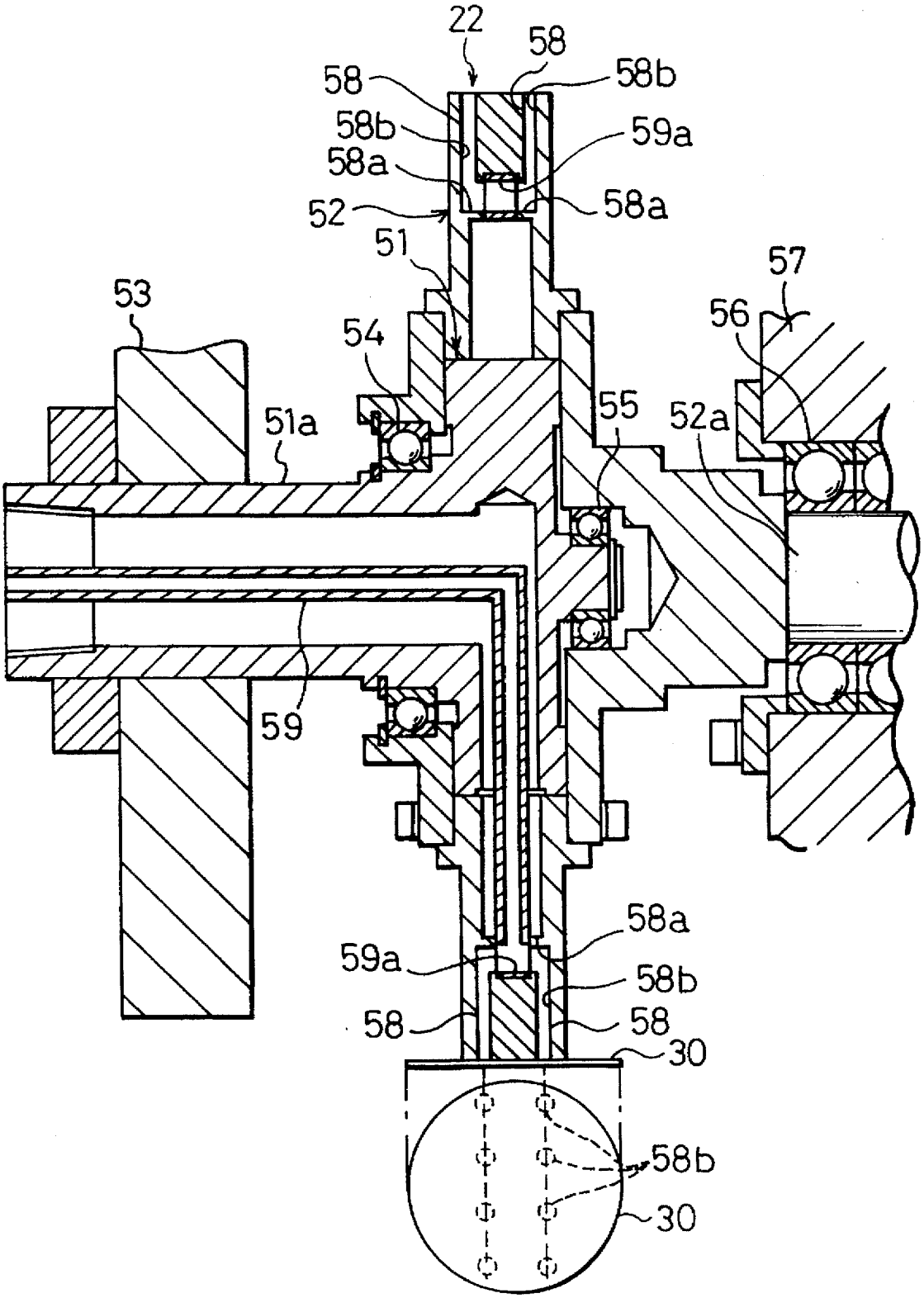
FIG. 4 is a longitudinal section of a delivery drum unit of FIG. 1.

As shown in FIG. 4, the delivery drum unit 22 includes a fixing roller 51 and a rotating roller 52 attached to the outer surface of the fixing roller 51. An axial section **51*a* of the fixing roller 51 is fixed to a fixing member 53 to inhibit the rotation of the fixing roller 51. The rotating roller 52 is attached to the fixing roller 51 through bearings 54 and 55, and an axial section 52*a* thereof is supported by a fixing member 57 through a bearing 56. The axial section 52*a*** is driven by unillustrated driving means.

Like the rotating drum section 31, the rotating roller 52 includes a plurality of separate suction sections 58 as shown in FIG. 4. The suction sections 58 are formed in two columns along the circumference of the rotating roller 52 at regular pitches. Each suction section 58 comprises a circular hole portion **58*a* and a nozzle portion 58*b*. The nozzel portions 58*b* is a hole extending from the circular hole portion 58*a* to the outer surface of the rotating roller 52, whose diameter is smaller than that of the circular hole portion 58*a*. As shown in FIG. 4, the opening of each nozzle portion 58*b* across the outer surface of the rotating roller section 52 is located within the diameter of the oxygen absorbing sheet tip 30 transported forward by the rotating roller 52** at the center across the outer surface thereof.

Figure 10:
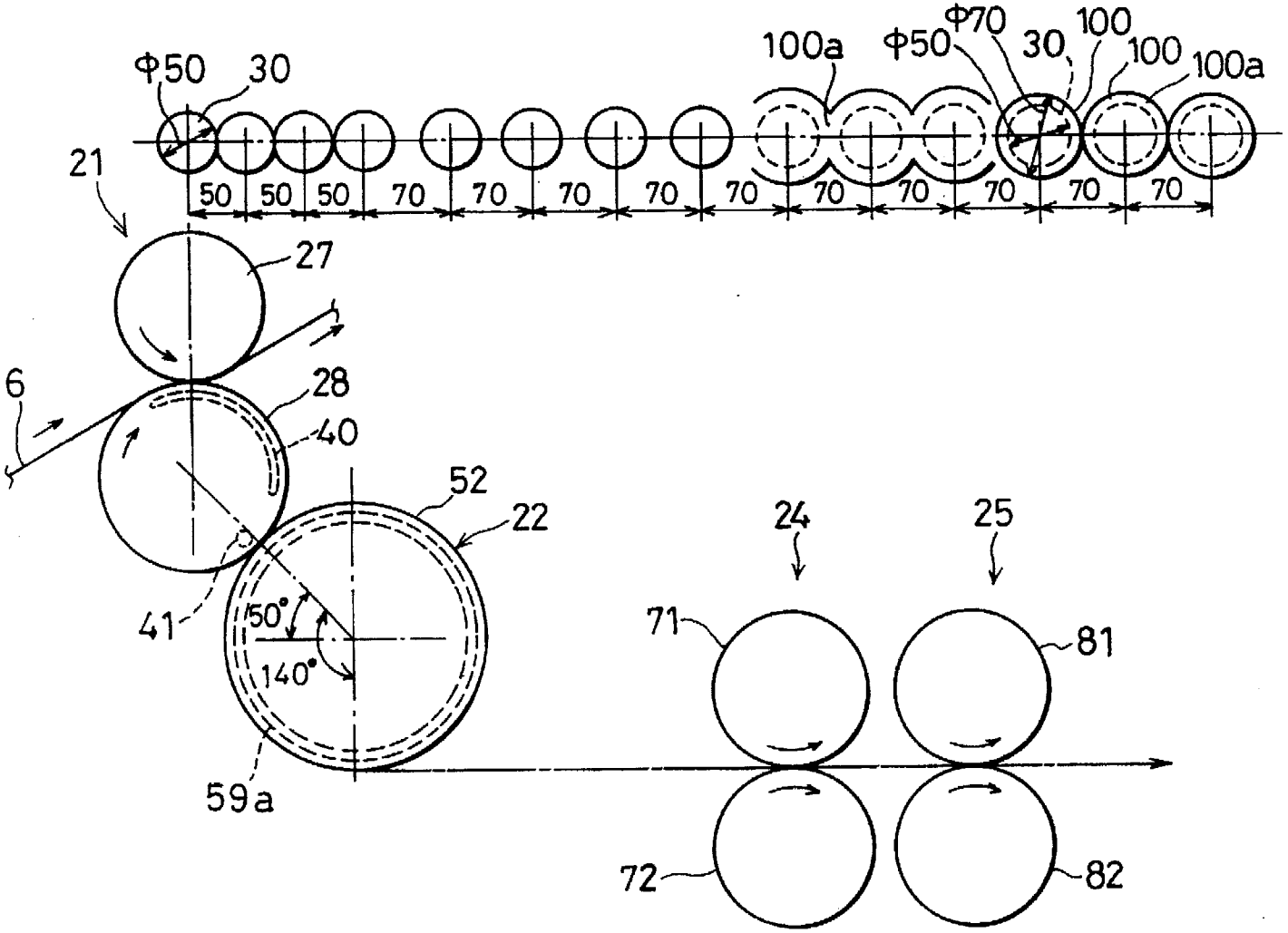
FIG. 10 is a view explaining the correspondence between major means of FIG. 1 and the producing steps of a sheet wrapping body.

A negative pressure supply path 59 to the suction sections 58 are provided inside the fixing roller 51 and rotating roller 52. The negative pressure supply path 59 is connected to an unillustrated air vacuuming unit at one end and extends to the suction sections 58 at the other end. The extended end portions serve as negative pressure supply holes **59*a*. As shown in FIG. 10, the negative pressure supply holes 59*a* are made around the rotating roller 52. Thus, there develops an attracting force all over the outer surface of the rotating roller 52, namely, the delivery drum unit 22**.

The outer surface of the rotating roller 52 is smaller than the 50 mm-dia oxygen absorbing sheet tip 30 in width, and the peripheral speed of the rotating roller 52 is faster than that of the anvil roller 28. Therefore, as shown in FIG. 1, the oxygen absorbing sheet tips 30 are delivered from the anvil roller 28 to the delivery drum unit 22 at regular intervals.

Figure 5:
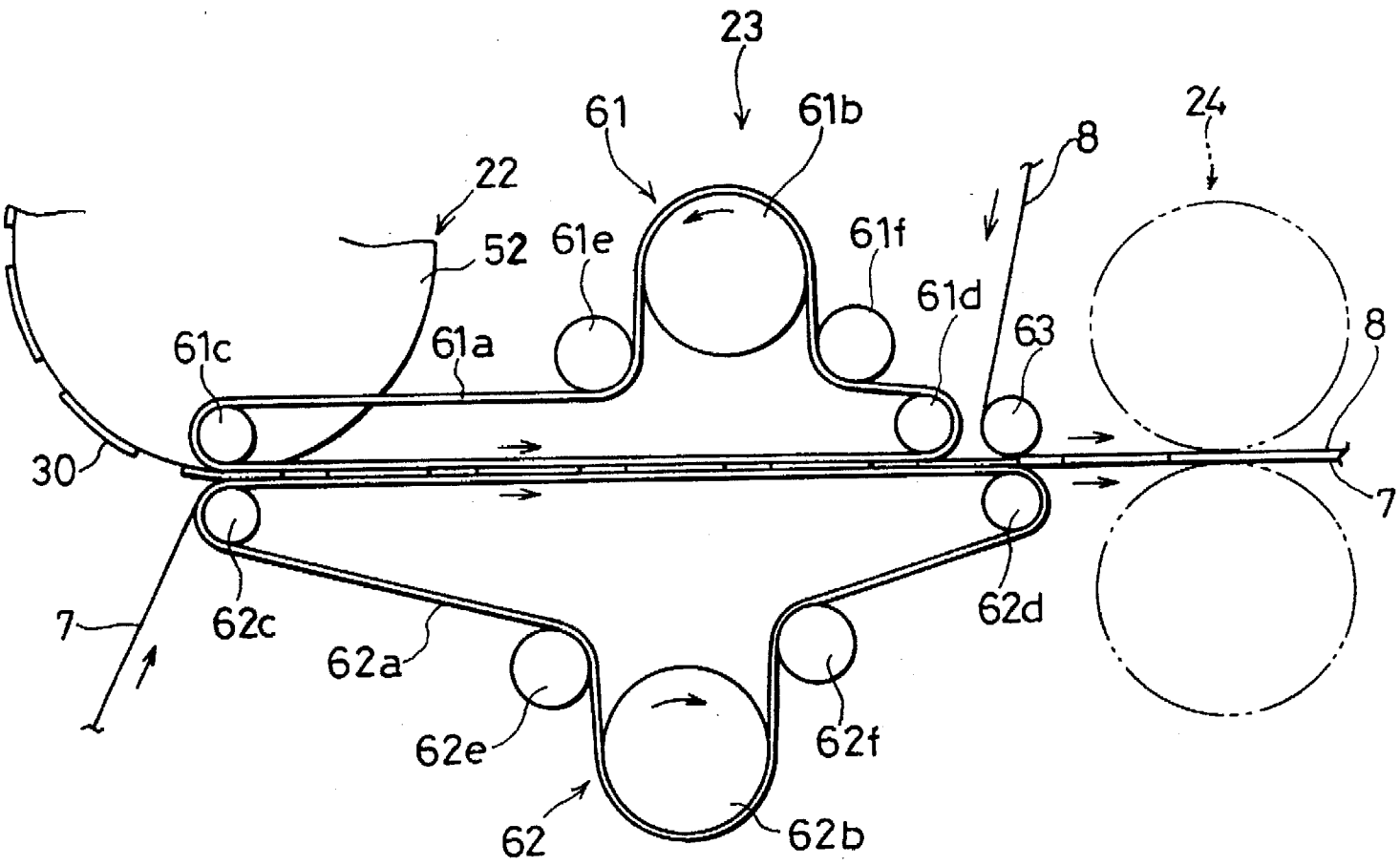
FIG. 5 is a schematic front view of a first transportation belt unit of FIG. 1.
Figure 7:
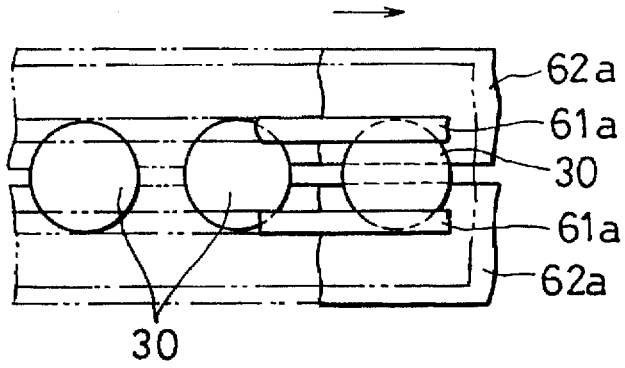
FIG. 7 is a plan view of a major portion showing the relationship between the position of round belts of a round belt unit of FIG. 5 and a diameter of an oxygen absorbing sheet tip.

As shown in FIG. 5, the first transportation belt unit 23 includes a round belt unit 61 (an upper transportation belt unit or upper transportation unit) and a flat belt unit 62 (a lower transportation belt unit or lower transportation unit). As shown in FIG. 7, the round belt unit 61 moves two round belts 61*a* aligned in parallel. The two round belts 61*a* are respectively located along the two opposing sides of the rotating roller 52 where the transportation begins. In other words, the interval between the two round belts 61*a* is longer than the width of the rotating roller 52 but smaller than the diameter of the oxygen absorbing sheet tip 30. The round belt unit 61 drives the two round belts 61*a* to rotate using a driving roller 61*b*, a start edge support roller 61*c* provided at an edge where the transportation starts, an end edge support roller 61*d* provided at an edge where the transportation ends, and two guide rollers 61*e* and 61*f*.

Likewise, as shown in FIG. 7, the flat belt unit 62 moves two flat belts 62*a* aligned in parallel. The flat belt unit 62 drives the two flat belts 62*a* to rotate using a driving roller 62*b*, a start edge support roller 62*c*, an end edge support roller 62*d*, and two guide rollers 62*e* and 62*f*. The start edge support roller 62*c* of the flat belt unit 62 is placed directly below the start edge support roller 61*c* of the round belt unit 61 in a direction in which the oxygen absorbing sheet tips 30 are transported. On the other hand, the end edge support roller 62*d* of the flat belt unit 62 is placed ahead of the end edge support roller 61*d* of the round belt unit 61 in the same direction.

Figure 8:
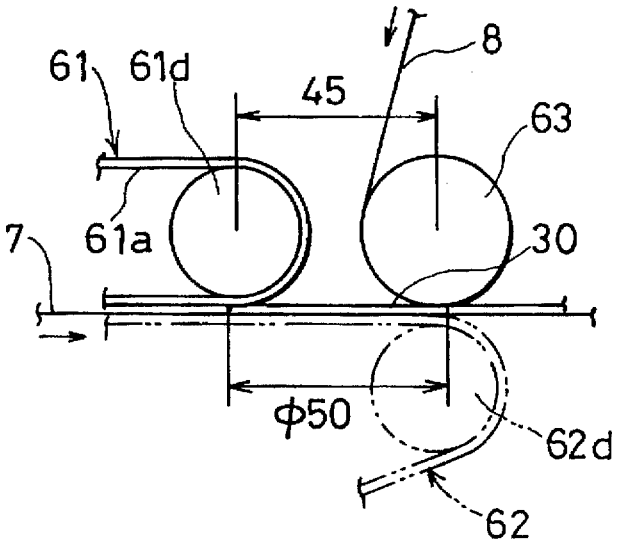
FIG. 8 is a front view of a major portion showing the relationship between the position of a guide roller with respect to the round belt unit of FIG. 5 and a diameter of an oxygen absorbing sheet tip.

A guide roller 63 is provided beyond the end edge support roller 61*d* in the transportation direction in such a manner to oppose the end edge support roller 62*d* of the round belt unit 62. The guide roller 63 guides the strip cover film 8 supplied from the cover film supply shaft 4 onto the oxygen absorbing sheet tips 30 placed on the breathing layer strip sheet 7. Further, the guide roller 63, together with the end edge support roller 61*d* of the round belt unit 61, transports the oxygen absorbing sheet tips 30 while maintaining their positions on the breathing layer strip sheet 7. In other words, the distance between the end edge support roller 61*d* and guide roller 63 is not longer than the diameter of the oxygen absorbing sheet tip 30. To be more specific, as shown in FIG. 8, the distance between the end edge support roller 61*d* and guide roller 63 is set to 45 mm in relation to the 50-mm-dia oxygen absorbing sheet tips 30 in the present embodiment. Therefore, the oxygen absorbing sheet tip 30 being delivered from the end edge support roller 61*d*, or the round belt 61*a*, to the guide roller 63 is always pressed against the breathing layer strip sheet 7 by at least the round belt 61*a* or guide roller 63.

As shown in FIG. 1, the rotary seal unit 24 includes a heat roller 71 and a receiving roller 72. The rotary seal unit 24 sandwiches the breathing layer strip layer 7 and strip cover film 8 using both the rollers 71 and 72. That is to say, the rotary seal unit 24 seals the breathing layer strip layer 7 and strip cover film 8 with the oxygen absorbing sheet tips 30 in between by heat and pressure. As shown in FIG. 10, sealed portions 100*a* of the breathing layer strip sheet 7 and strip cover film 8 between every two adjacent oxygen absorbing sheet tips 30 are connected sequentially in the transportation direction with no space in between.

The second rotary die cut unit 25 includes a cut roller 81 and an anvil roller 82, which are slightly spaced apart and oppose each other vertically. The second rotary die cut unit 25 cuts out the oxygen absorbing sheet tips 30 covered with the breathing layer strip sheet 7 and strip cover film 8, namely, sheet wrapping bodies 100 shown in FIG. 1, from a strip of sealed sheet supplied through a space between the rollers 81 and 82 as they rotate.

In the present embodiment, the second rotary die cut unit 25 cuts out the 70-mm-dia sheet wrapping bodies 100 from the sealed sheet continuously in a direction in which the second rotary die cut unit 25 rotates without leaving any unwanted space between every two adjacent sheet wrapping bodies 100.

Figure 6:
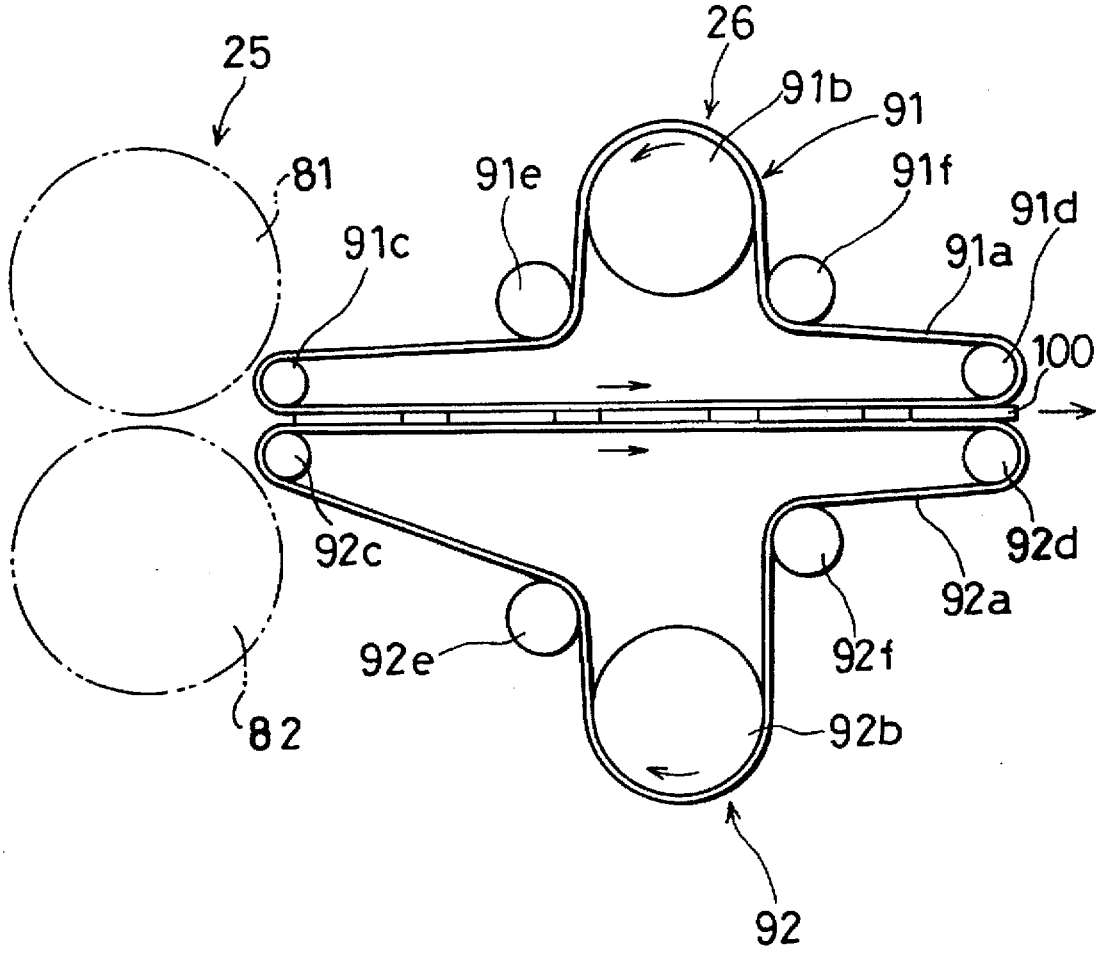
FIG. 6 is a schematic front view of a second transportation belt unit of FIG. 1.
Figure 9:
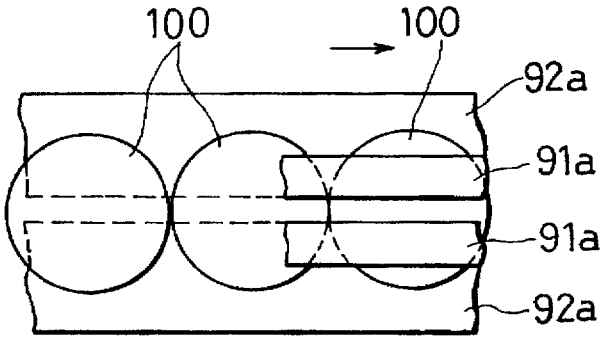
FIG. 9 is a plan view of a major portion showing the relationship between the position of the round belts of the round belt unit of FIG. 5 and a diameter of an oxygen absorbing sheet tip.

As shown in FIG. 6, the second transportation belt unit 26 includes an upper round belt unit 91 and a lower flat belt unit 92. As shown in FIG. 9, the former moves two round belts 91*a* aligned in parallel. The interval between the two round belts 91*a* is shorter than the diameter of the sheet wrapping body 100. The round belt unit 91 drives the two round belts 91*a* to rotate using a driving roller 91*b*, a start edge support roller 91*c* provided at an edge where the transportation starts, an end edge support roller 91*d* provided at an edge where the transportation ends, and two guide rollers 91*e* an 91*f*.

Likewise, as shown in FIG. 9, the flat belt unit 92 moves two flat belts 92*a* aligned in parallel. The flat belt unit 92 drives the two flat belts 92 to rotate using a driving roller 92*b*, a start edge support roller 92*c*, an end edge support roller 92*d*, and two guide rollers 92*e* and 92*f*.

According to the structure with the above-explained units, the oxygen absorbing strip sheet 6 wound up around the oxygen absorbing sheet supply shaft 1 reaches the used oxygen absorbing sheet take-up shaft 2 after passing through the nip roller 9 and first rotary die cut unit 21 by way of the guide rollers 10 and 11. On the other hand, the breathing layer strip sheet 7 wound up around the breathing layer sheet supply shaft 3 reaches the used coating sheet take-up shaft 5 after passing through the first transportation belt unit 23, rotary seal unit 24, and second rotary die cut unit 25 by way of the guide roller 14. Also, the strip cover film 8 wound up around the cover film supply shaft 4 reaches the used coating sheet take-up shaft 5 after passing through the guide rollers 13 and 63, rotary seal unit 24, and second rotary die cut unit 25 by way of the guide roller To be more specific, according to the above structure, the oxygen absorbing strip sheet 6 supplied from the oxygen absorbing sheet supply shaft 1 is transported to a space between the cut roller 27 and anvil roller 28 of the first rotary die cut unit 21. Then, the first rotary die cut unit 21 cuts out the oxygen absorbing sheet tips 30 in succession from the oxygen absorbing strip sheet 6 by rotating the cut roller 27 and anvil roller 28. The oxygen absorbing sheet tips 30 thus made are attracted to the anvil roller 28 and transported forward as the anvil roller 28 rotates. On the other hand, the oxygen absorbing strip sheet 6 having passed through the first rotary die cut unit 21 is reeled up around the used oxygen absorbing take-up shaft 2 as the used oxygen absorbing sheet. The oxygen absorbing sheet tips 30 are cut out successively in such a manner that every two adjacent tips 30 are hardly spaced apart. Thus, every two adjacent oxygen absorbing sheet tips 30 touch, or almost touch each other while being transported by adhering to the anvil roller 28.

The oxygen absorbing sheet tips 30 are delivered to the delivery drum unit 22 from the anvil roller 28 when they are transported to a point where the anvil roller 28 opposes the delivery drum unit 22. At this point, as shown in FIG. 3, the suction sections 39 of the anvil roller 28 attracting the oxygen absorbing sheet tips 30 come outside the negative pressure area setting groove 40. Thus, such suction sections 39 no longer develop the attracting force with respect to the oxygen absorbing sheet tips 30. In addition, to prevent the oxygen absorbing sheet tips 30 from being attracted by residual negative pressure in the suction sections 39, compressed air is forcibly blown into the suction sections 39 from the positive supply hole 41 when the suction sections 39 reach the positive pressure supply hole 41. As a result, the oxygen absorbing sheet tips 30 are delivered from the anvil roller 28 to the delivery drum unit 22 in a secured manner.

The peripheral speed of the delivery drum unit 22 is faster than that of the anvil roller 28. Thus, the oxygen absorbing sheet tips 30 are delivered from the anvil roller 28 to the delivery drum unit 22 in such a manner to align on the outer surface of the delivery drum unit 22 at regular intervals. The interval between two adjacent oxygen absorbing sheet tips 30 is as long as the width of the sealed portion 100*a* between two adjacent oxygen absorbing sheet tips 30 made by the rotary seal unit 24 shown in FIG. 10.

The oxygen absorbing sheet tips 30 transported to the first transportation belt unit 23 by the delivery drum unit 22 are forcibly removed from the delivery drum unit 22 by the two round belts 61*a* of the round belt unit 61 placed above the oxygen absorbing sheet tips 30. Then, the oxygen absorbing sheet tips 30 are placed on the breathing layer strip sheet 7 supplied on the two flat belts 62*a* of the flat belt unit 62. Subsequently, the oxygen absorbing sheet tips 30 are transported further while being fastened by the two round belts 61*a* and two flat belts 62*a*.

Then, the oxygen absorbing sheet tips 30 are transported to the end edge support roller 61*d* of the round belt unit 61 and delivered further to the guide roller 63 while being fastened by both the guide roller 63 and the end edge support roller 61*d*, namely, the two round belts 61*a*. Thus, the oxygen absorbing sheet tips 30 are delivered while maintaining their positions.

Next, the upper surfaces of the oxygen absorbing sheet tips 30 having reached the guide roller 63 are covered with the strip cover film 8 supplied from above. Therefore, from this point, the oxygen absorbing sheet tips 30 are sandwiched by the lower breathing layer strip sheet 7 and upper strip cover film 8, and transported further while maintaining their positions with respect to the breathing layer strip sheet 7 and strip cover film 8.

The lamination of the strip cover film 8, oxygen absorbing sheet tips 30, and breathing layer strip sheet 7 reaches the rotary seal unit 24, and the circumference of each oxygen absorbing sheet tip 30 is sealed by the rotary seal unit 24. Then, the sealed sheet is transported further to the second rotary die cut unit 25 and cut out in the sealed portion 100*a* around each oxygen absorbing sheet tip 30, thereby producing the sheet wrapping bodies 100. The second rotary die cut unit 25 cuts the sealed sheet in such a manner to leave no space between every two adjacent sheet wrapping bodies 100.

Subsequently, the used breathing layer strip sheet 7 and strip cover film 8 are reeled up around the used coating sheet take-up shaft 5 by way of the guide roller 14. On the other hand, the sheet wrapping bodies 100 are transported further while being fastened from above and underneath by the transportation belt unit 26 to maintain their positions, and carried into an unillustrated container section or the like.

As has been explained, the sheet wrapping body producing apparatus of the present embodiment has a single linear transportation path as the producing line that starts with the production of the oxygen absorbing sheet tips 30 and ends with the production of the sheet wrapping bodies 100. Therefore, the sheet wrapping body producing apparatus can omit some spaces compared with a counterpart that transports the oxygen absorbing sheet tips 30 in one transportation path and produces the sheet wrapping bodies 100 in another transportation path having a different transportation direction. As a result, it has become possible to downsize the sheet wrapping body producing apparatus.

Accordingly, the sheet wrapping body producing apparatus of the present embodiment obviates a complicated control using a number of sensors or the like, and thus comprises fewer components and can be controlled by a simpler manner, thereby realizing a low running-cost apparatus.

In the sheet wrapping body producing apparatus of the present embodiment, the oxygen absorbing sheet tips 30 are cut out from the oxygen absorbing strip sheet 6 by the first rotary die cut unit 21, the breathing layer strip sheet 7 and strip cover film 8 are sealed with the oxygen absorbing sheet tips 30 in between by the rotary seal unit 24, and the sheet wrapping bodies 100 are cut out from the sealed sheet by the second rotary die cut unit 25. Since each of the above three units comprises a pair of rotating rollers, the above actions can be carried out in succession at high speeds.

Also, to ensure such a successive and fast operation, the oxygen absorbing sheet tips 30 are transported while maintaining their positions. Consequently, the sheet wrapping bodies can be produced at high speeds.

The oxygen absorbing sheet tips 30 made by the first rotary die cut unit 21 are attracted to the anvil roller 28 and delivered to the delivery drum unit 22, which attracts and delivers the same to the first transportation belt unit 23. Thus, once the oxygen absorbing sheet tips 30 are made, the same are transported sequentially at high speeds without causing any-misalignment until they are supplied onto the breathing layer strip sheet 7.

Also, a space between the adjacent oxygen absorbing sheet tips 30 can be readily determined by adjusting the difference in peripheral speed between the anvil roller 28 and delivery drum unit 22.

When the oxygen absorbing sheet tips 30 are delivered from the delivery drum unit 22 to the first transportation belt unit 23, the oxygen absorbing sheet tips 30 are removed from the delivery drum unit 22 by the round belt unit 61 of the first transportation belt unit 23 and placed on the flat belt unit 62. Then, the oxygen absorbing sheet tips 30 are transported further while being fastened by the flat belt unit 62 and round belt unit 61. Thus, the oxygen absorbing sheet tips 30 are delivered from the delivery drum unit 22 to the first transportation belt unit 23 in a satisfactory manner without causing any misalignment.

When the strip cover film 8 is supplied onto the oxygen absorbing sheet tips 30, the oxygen absorbing sheet tips 30 are released from the fastening of the round belt unit 61 and flat belt unit 62, but instead, fastened by the guide roller 63 and flat belt unit 62. To be more specific, when the oxygen absorbing sheet tips 30 are delivered from the round belt unit 61 to the guide roller 63, the top end of each oxygen absorbing sheet tip 30 is fastened by the guide roller 63 and flat belt unit 62 before the bottom end thereof passes by the round belt unit 61. Thus, the oxygen absorbing sheet tips 30 are always fastened at the top or bottom end at the time of delivery, thereby causing no misalignment.

Also, the first rotary die cut unit 21 and second rotary die cut unit 25 respectively cut out the oxygen absorbing strip sheet 6 and the sealed sheet in their respective rotational directions in such a manner not to leave any unwanted space between every two adjacent oxygen absorbing sheet tips 30 and between every two adjacent sheet wrapping bodies 100, respectively. In addition, a space as large as the sealed portion 100*a* produced by the rotary seal unit 24 is secured between the adjacent oxygen absorbing sheet tips 30 by setting the peripheral speeds of the rotating the anvil roller 28 and delivery drum unit 22 adequately. Thus, the sheet wrapping bodies 100 can be produced at high speeds while reducing the wasted material as much as possible.

The sheet wrapping bodies 100 produced by the sheet wrapping body producing apparatus of the present embodiment wrap the oxygen absorbing sheets. However, the structure of the sheet wrapping bodies 100 is not limited to the above. The sheet wrapping bodies 100 may wrap other types of sheets instead of the oxygen absorbing sheets, for example, medicated sheets releasing the medicated components.

The first transportation belt unit 23 uses the round belt unit 61 in the present embodiment. However, the round belt unit 61 may be replaced with a flat belt unit similar to the flat belt unit 62. In this case, the width of the flat belts limits the transportation, but the frictional force with respect to the oxygen absorbing sheet tips 30 increases, thereby making it possible to transport the oxygen absorbing sheet tips 30 in a more satisfactory manner after all.

In the sheet wrapping body producing apparatus in accordance with the present embodiment, it is a heat-seal action of the rotary seal unit 24 that determines the operation speed. Thus, it is preferable to pre-heat the strip cover film 8 alone or both the strip cover film 8 and breathing layer strip sheet 7 to speed up the operation.

Alternatively, the breathing layer strip sheet 7 may be bonded to the strip cover film 8 with an adhesive agent. In this case, the adhesive agent is spread all over the breathing layer strip sheet 7 on the surface opposing the strip cover film 8, and the breathing layer strip sheet 7 is supplied as a paper covering the adhesive surface is peeled off. Here, the rotary seal unit 24 applies only a pressure against the sheets subject to sealing.

(Second Embodiment)

Referring to FIGS. 11 through 19, the following description will describe another example embodiment of the present invention. Hereinafter, like components are labeled with like reference numerals with respect to the first embodiment, and the description of these components is not repeated for the explanation's convenience.

Figure 11:
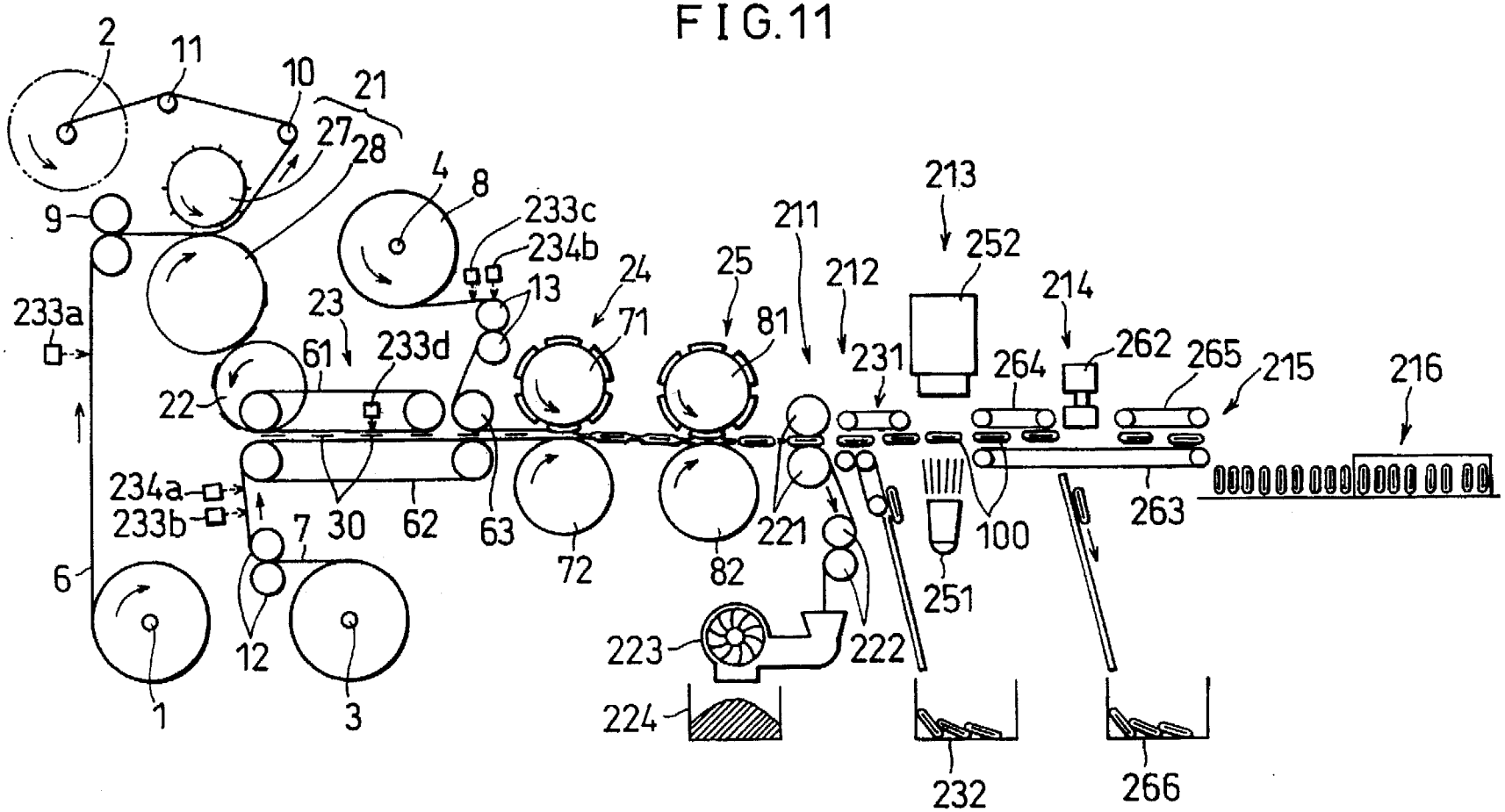
FIG. 11 is a view showing the entire structure of a sheet wrapping body producing apparatus in accordance with another example embodiment of the present invention.

FIG. 11 shows a schematic structure of a sheet wrapping body producing apparatus in accordance with the present embodiment. The sheet wrapping body producing apparatus includes the same structure as the counterpart of the first embodiment in the first half stage except that the used coating sheet take-up shaft 5 is replaced with a used coating sheet cut and collect unit 211.

The used coating sheet cut and collect unit 211 includes a pair of guide rollers 221, another pair of guide rollers 222, a cut blower 223, and a collecting box 224. In the used coating sheet cut and collect unit 211, the used breathing layer strip sheet 7 and strip cover film 8 are transported into the cut blower 223 by way of the pair of guide rollers 222, cut into pieces, and collected in the collecting box 224.

Figure 12:
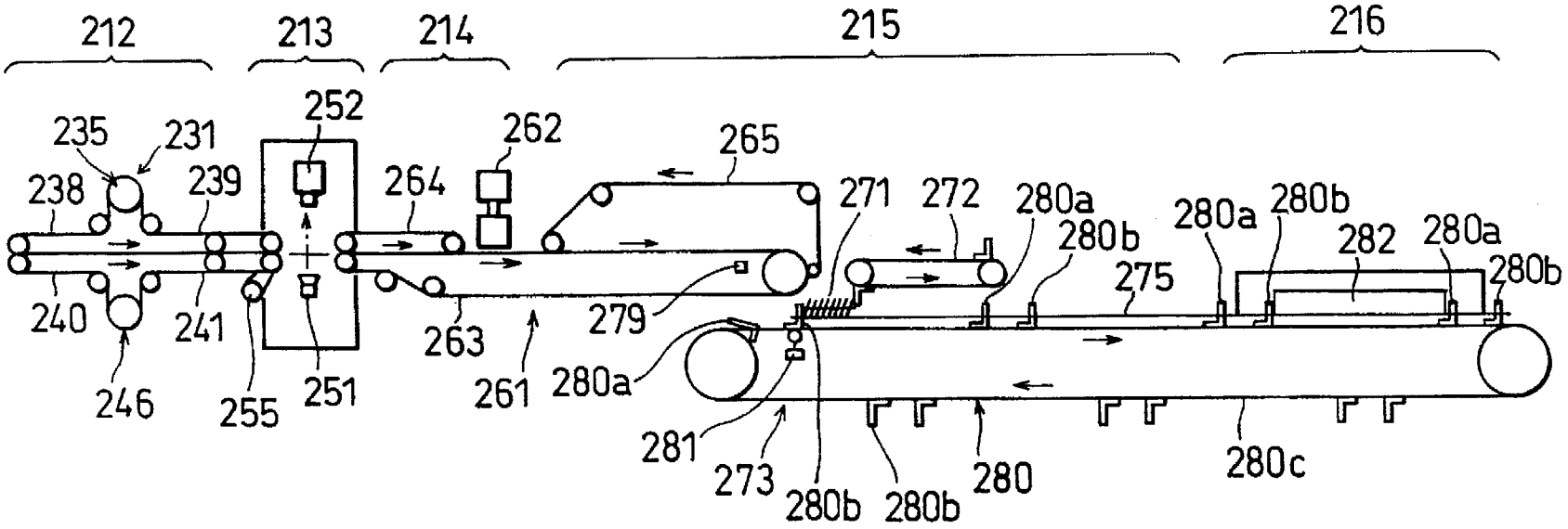
FIG. 12 is a view detailing the structure of a second half stage of the sheet wrapping body producing apparatus of FIG. 11.

The structure beyond the guide rollers 221 in FIG. 11 is the second half stage of the sheet wrapping body producing apparatus herein. The second half stage includes the following components sequentially in a direction in which the sheet wrapping bodies 100 are transported: a first defective body collecting section 212, a translucent defective body detecting section 213 (second defect detecting means), a second defective body collecting section 214, an aligning and transporting section 215 (aligning and transporting means), and a boxing section 216. FIG. 12 depicts the structure of the second half stage.

The first defective body collecting section 212 includes a second transportation belt unit 231, a collecting box 232, color sensors 233*a*–233*d* (first defect detecting means), and photoelectric sensors 234*a* and 234*b* (first defect detecting means). Note that the color sensors 233*a*–233*d* and photoelectric sensors 234*a* and 234*b* are provided in the first half stage to detect a defect in advance.

Figure 14:
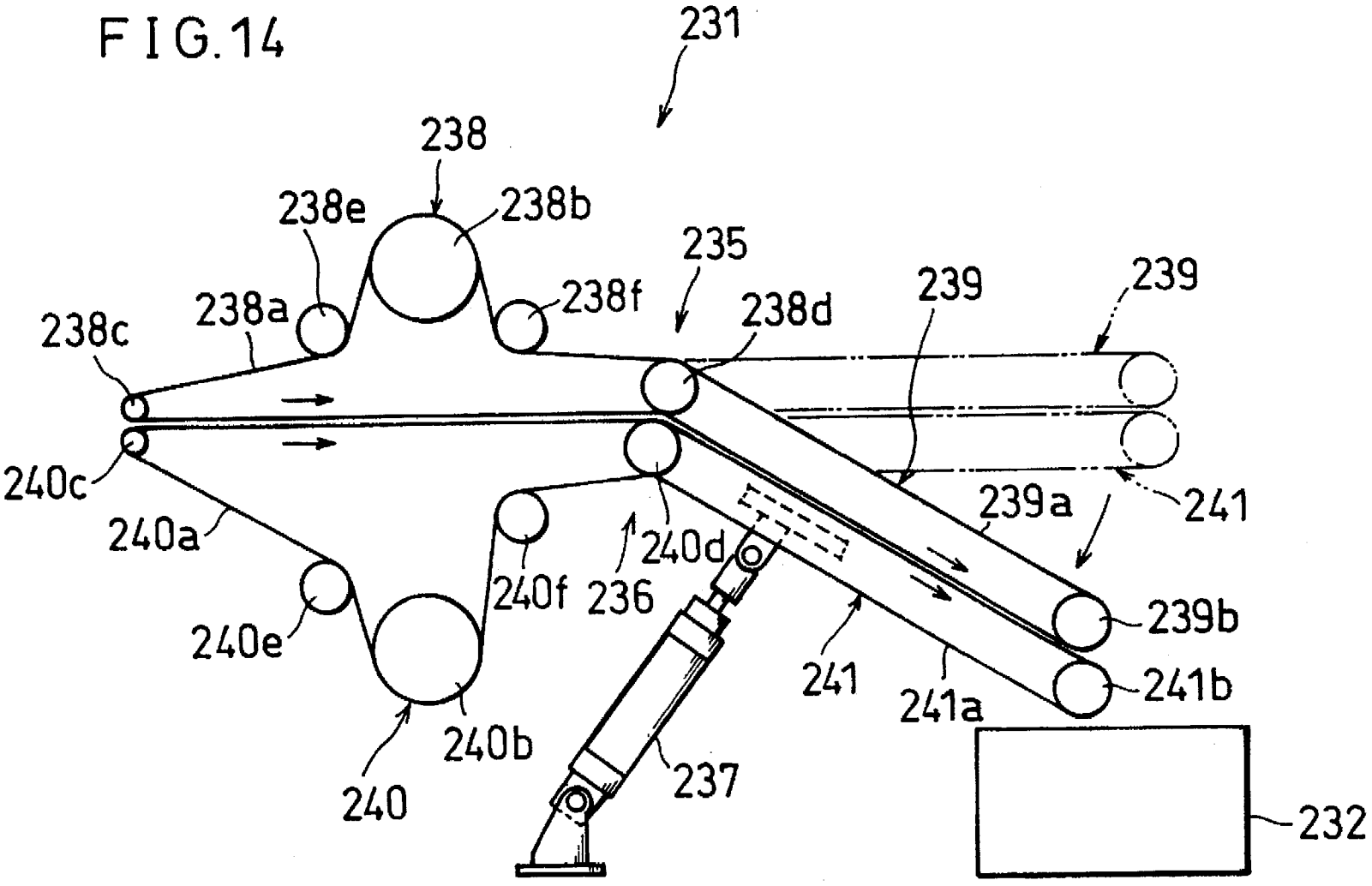
FIG. 14 is a magnified view of a second transportation belt unit of FIG. 12.

As shown in FIG. 14, the second transportation belt unit 231 includes an upper belt unit 235, a lower belt unit 236, and a cylinder 237. The upper belt unit 235 and lower belt unit 236 fasten the sheet wrapping bodies 100 and transport the same.

The upper belt unit 235 includes a forward belt unit 238 and an aft belt unit 239. The former comprises a belt 238*a*, a driving roller 238*b*, two supporting rollers 238*c* and 238*d*, and two guide rollers 238*e* and 238*f*. The latter comprises a belt 239*a*, a supporting roller 239*b*, and the supporting roller 238*d*. The belt 238*a* is driven by the driving roller 238*b* and moves in the direction indicated by an arrow in the drawing. The belt 239*a* moves together with the supporting roller 238*d* which rotates as the belt 238*a* moves.

Likewise, the lower belt unit 236 includes a forward belt unit 240 and an aft belt unit 241. The former comprises a belt 240*a*, a driving roller 240*b*, two supporting rollers 240*c* and 240*d*, and two guide rollers 240*e* and 240*f*. The latter comprises a belt 241*a*, a supporting roller 241*b*, and the supporting roller 240*d*. The belt 240*a* is driven by the driving roller 240*b* and moves in the direction indicated by an arrow in the drawing. The belt 241*a* moves together with the supporting roller 240*d* which rotates as the belt 240*a* moves.

Both the aft belt units 239 and 241, as a single unit, turn respectively around the supporting rollers 238*d* and 240*d* from a transporting position indicated by a chain double-dashed line to a collecting position indicated by a solid line and vice versa. The aft belt units 239 and 241 are set in the transporting position when the sheet wrapping bodies 100 are transported further in the second half stage, and set in the collecting position when a defective sheet wrapping body 100 is thrown into the collecting box 232. The aft belt units 239 and 241 are turned by the cylinder 237. This means that the aft belt units 239 and 241 and the cylinder 237 form first removing means.

The color sensors 233*a*, 233*b*, and 233*c* detect seams of the oxygen absorbing strip sheet 6, breathing layer strip sheet 7, and strip cover film 8, respectively.

The seams referred herein are, in case of the oxygen absorbing strip sheet 6, the joints between the bottom end portion of an oxygen absorbing strip sheet 6 and the top end portion of a following one. As has been explained, the sheet wrapping body producing apparatus of the present embodiment produces a sheet wrapping body at high speeds by supplying the oxygen absorbing strip sheet 6, breathing layer strip sheet 7, and strip cover film 8 continuously. Therefore, when a roll of the oxygen absorbing strip sheet 6 is used up, the bottom end portion thereof is jointed with the top end of another roll of the oxygen absorbing strip sheet 6 to resume the supply of the oxygen absorbing strip sheet 6 swiftly, ensuring high productivity. This is how the oxygen absorbing strip sheet 6 includes the seam and such a oxygen absorbing strip sheet 6 is supplied to the sheet wrapping body producing apparatus. The same can be said with the breathing layer strip sheet 7 and strip cover film 8.

Sheet wrapping bodies 100 including the seam must be removed as defective ones, and the color sensors 233*a*–233*c* detect the seams based on the changes in color.

The photoelectric sensors 234*a* and 234*b* detect the snaking of the breathing layer strip sheet 7 and strip cover film 8, respectively. In case of the photoelectric sensor 234*a*, a pair of sensors are provided at the two opposing end sides of the breathing layer strip sheet 7, and the snaking of the breathing layer strip sheet 7 is detected based on variance in amount of reflected light. The same applies to the relationship between the photoelectric sensor 234*b* and strip cover film 8.

If the breathing layer strip sheet 7 or strip cover film 8 snakes during the transportation, the oxygen absorbing sheet tips 30 are not covered with the coating materials in a satisfactory manner, or the oxygen absorbing sheet tips 30 are put to one side within the sheet wrapping bodies 100. Such sheet wrapping bodies 100 reduces the commercial value and must be removed. This is the reason why the photoelectric sensors 234*a* and 234*b* detect the snaking of the breathing layer strip sheet 7 and strip cover film 8, respectively.

The color sensor 233*d* detects the right and back sides of the oxygen absorbing sheet tips 30 and the pitches therebetween. The oxygen absorbing sheet 6, namely, the oxygen absorbing sheet tips 30, must oppose the breathing layer strip sheet 7 at the oxygen absorbing surface; otherwise, the oxygen absorbing sheet tips 30 do not absorb oxygens as good as they should. Also, the right and back sides of the oxygen absorbing sheet tips 30 have different colors and luster. This is the reason why the right and back sides of the oxygen absorbing sheet tips 30 are detected by the color sensor 233*d*. Note that the color sensor 233*d* has to carry out the detection only once for a roll of the oxygen absorbing strip sheet 6.

Also, if a pitch between two adjacent oxygen absorbing sheet tips 30 varies from a predetermined pitch, some sheet wrapping bodies 100 may cause defects at the sealing steps at the rotary seal unit 24 and at the cutting out step at the rotary die cut unit 25. Therefore, the color sensor 233*d* detects the pitches between the oxygen absorbing sheet tips 30 to remove the defective sheet wrapping bodies 100.

When any of the color sensors 233*a*–233*d* and photoelectric sensors 234*a* and 234*b* detects a defect, such a defective sheet wrapping body 100 is removed by the first defective body collecting section 212. To enable the above removal, the sheet wrapping body producing apparatus of the present embodiment additionally includes a control unit 217 shown in FIG. 13. The control unit 217 comprises, for example, a microcomputer and judges a defect based on detection signals from the color sensors 233*a*–233*d* and photoelectric sensors 234*a* and 234*b*. In addition, the control unit 217 controls the cylinder 237, so that the aft belt units 239 and 241 of the second transportation belt unit 231 is turned to the collecting position in response to the notice of defect from any of the above sensors. Accordingly, defective sheet wrapping bodies 100 are thrown into the collecting box 232.

In practice, the control unit 217 computes a driving timing of the cylinder 237 based on the position of each sensor and the transportation speed of the sheet wrapping bodies 100 or the like. If a defective sheet wrapping body 100 can not be specified at the first defective body collecting section 212, some of the sheet wrapping bodies 100 before and after the one in question may be also removed.

Figure 13:
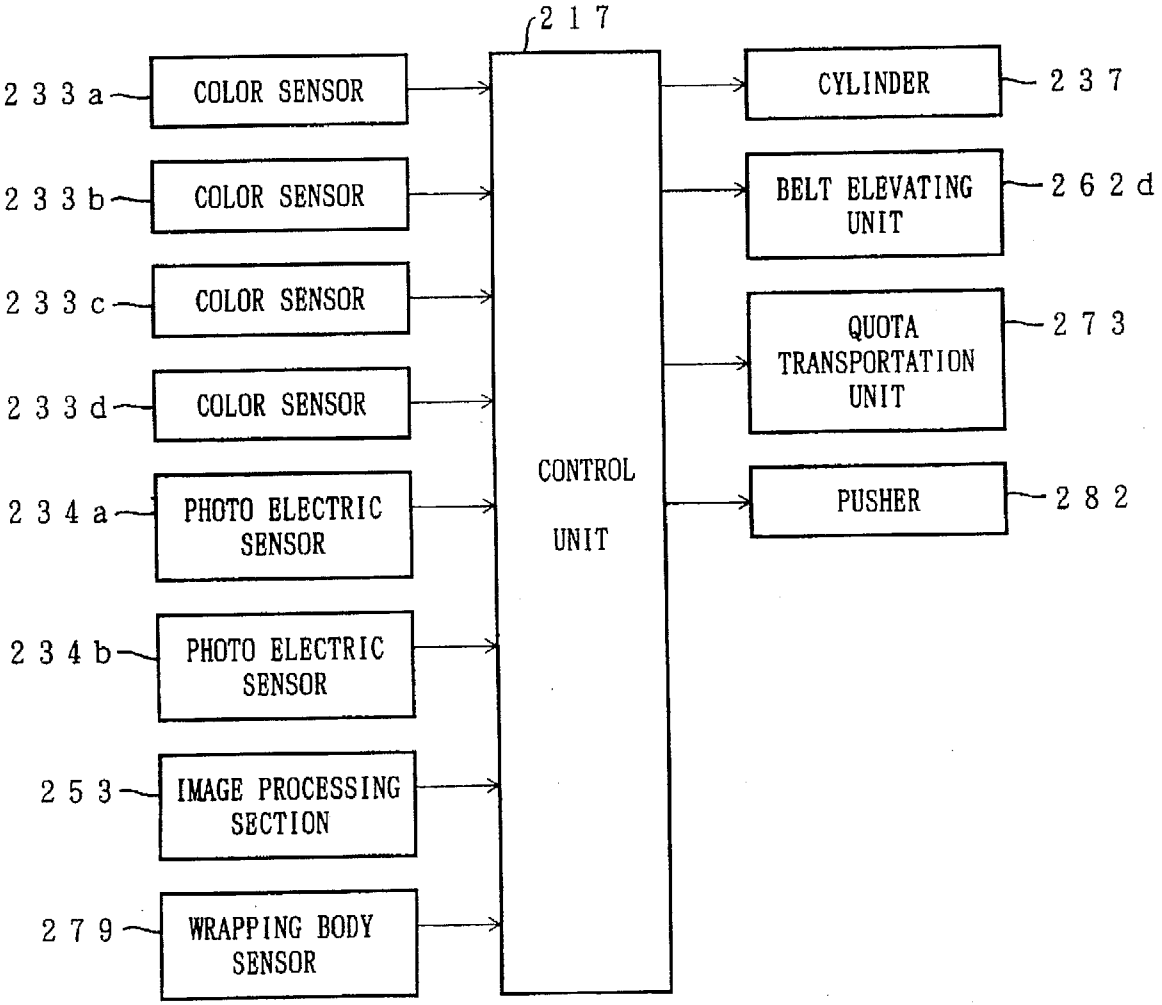
FIG. 13 is a block diagram depicting a control system provided in the sheet wrapping body producing apparatus of FIG. 11.
Figure 15:
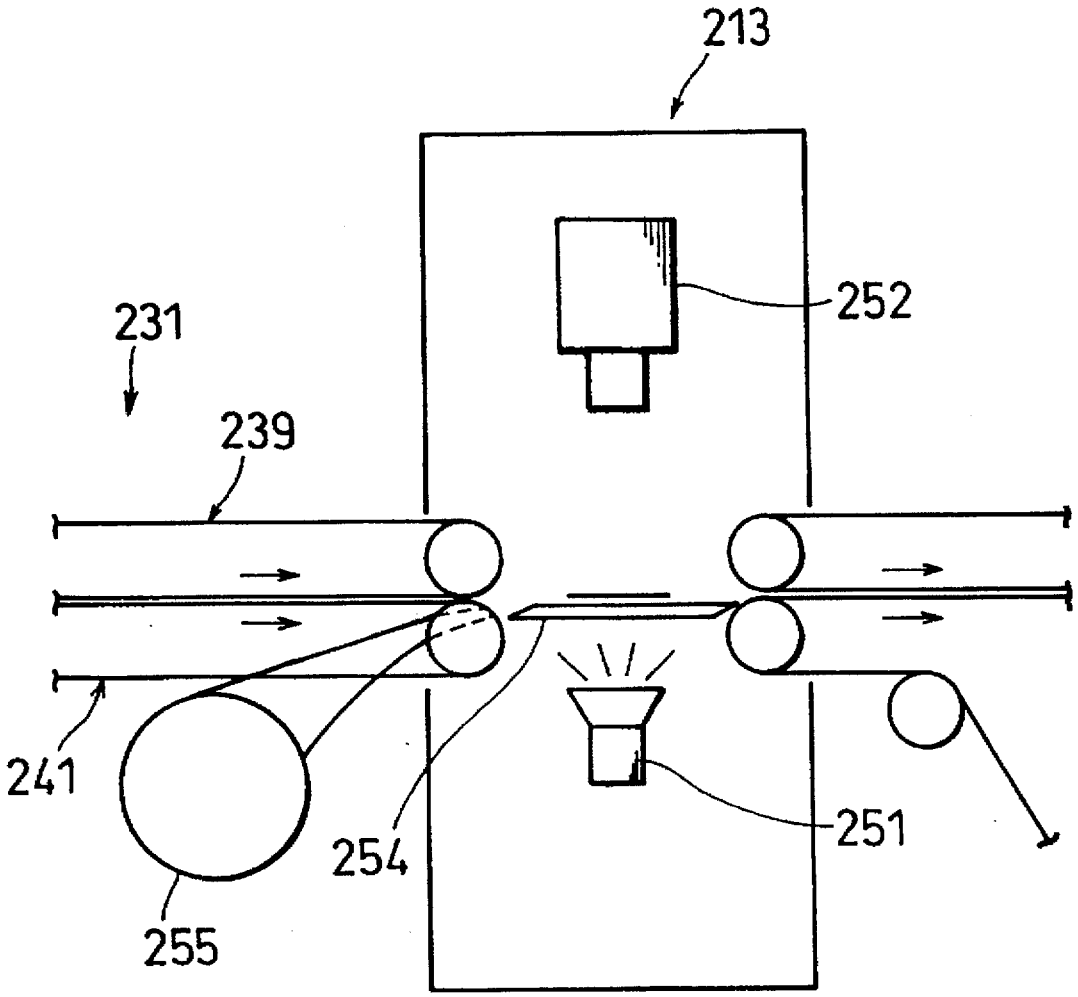
FIG. 15 is a magnified view around a translucent defective body detecting section of FIG. 12.

The translucent defective body detecting section 213 includes a light source 251, a camera section 252, a glass plate 254, a transportation blower 255, and an image processing section 253. The last referred component is shown in FIG. 13 and the rest are shown in FIG. 15. The glass plate 254 is provided in a transportation path of the sheet wrapping bodies 100 between the first defective body collecting section 212 and second defective body collecting section 214. The light source 251 is provided under the glass plate 254 to irradiate light to the sheet wrapping body 100 on the glass plate 254. The camera section 252 is placed to oppose the light source 251 with the glass plate 254 in between. The camera section 252 picks up an image of the sheet wrapping body 100 and converts the image into image data. The image processing section 253 processes the image data from the camera section 252 and judges whether the sheet wrapping body 100 is defective or not. The transportation blower 255 produces an air layer on the glass plate 254, so that the sheet wrapping body 100 is transported without touching the glass plate 254.

In the translucent defective body detecting section 213, whether the sheet wrapping body 100 contains the oxygen absorbing sheet chip 30 or not is detected first. Then, whether the outer dimensions of the sheet wrapping body 100 is within the specification or not is detected.

Although the image processing section 253 may judge a defect using a known algorithm for graphic analysis, an amount of data can be reduced by another method using the feature extraction of the original image to speed up the judgment. That is to say, by extracting only the features, such as edges of the original image, the original image on a plane (two dimension) can be treated as lines (one dimension), thereby making it possible to reduce a volume of image data.

The sheet wrapping body 100 is irradiated by the high-intensity light source 251 in such a manner that the back ground gives no adverse effects. Thus, the contour of the sheet wrapping body 100 and the contents thereof, namely, the shadow of the oxygen absorbing sheet tip 30, is picked up.

Subjects of detection by the translucent defective body detecting section 213, color sensors 233*a*–233*d*, and photoelectric sensors 234*a* and 234*b* are set forth in TABLE 1 below.

TABLE 1

| ITEMS | SUBJECTS | COMPONENTS |
|---|---|---|
| SEAMS | OXYGEN ABSORBING STRIP SHEET | COLOR SENSOR 233a |
| | BREATHING LAYER STRIP SHEET | COLOR SENSOR 233b |
| | STRIP COVER FILM | COLOR SENSOR 233c |
| SNAKING (MISALIGNMENT) | BREATHING LAYER STRIP SHEET | PHOTOELECTRIC SENSOR 234a |
| | STRIP COVER FILM | PHOTOELECTRIC SENSOR 234b |
| DIMENSION | PRODUCT | TRANSLUCENT DEFECTIVE BODY DETECTING SECTION 213 |
| | OXYGEN ABSORBING SHEET TIP | TRANSLUCENT DEFECTIVE BODY DETECTING SECTION 213 |

TABLE 1-continued

| ITEMS | SUBJECTS | COMPONENTS |
|---|---|---|
| PRESENCE | OXYGEN ABSORBING SHEET TIP | TRANSLUCENT DEFECTIVE BODY DETECTING SECTION 213 COLOR SENSOR 233d |
| RIGHT/BACK SIDE | OXYGEN ABSORBING SHEET TIP | COLOR SENSOR 233d |

As shown in FIG. 12, the second defective body collecting section 214 comprises the first half portion of a third transportation belt 261 and a defective body removing unit 262 (second removing means). The third transport belt unit 261 includes a lower transport belt unit 263, an upper-forward transportation belt unit 264, and an upper-aft transportation belt unit 265. In the first half portion of the transportation belt unit 261, the sheet wrapping bodies 100 are transported while being fastened by the first half portion of the lower transportation belt unit 263 and upper-forward transportation belt unit 264. Whereas in the second half portion of the transportation belt unit 261, the sheet wrapping bodies 100 are transported while being fastened by the second half portion of the lower transportation belt unit 263 and the upper-aft transportation belt unit 265. Like the aforementioned transportation belt units, all the transportation belt units 263–265 move their respective belts that are supported by rollers.

Figure 16:
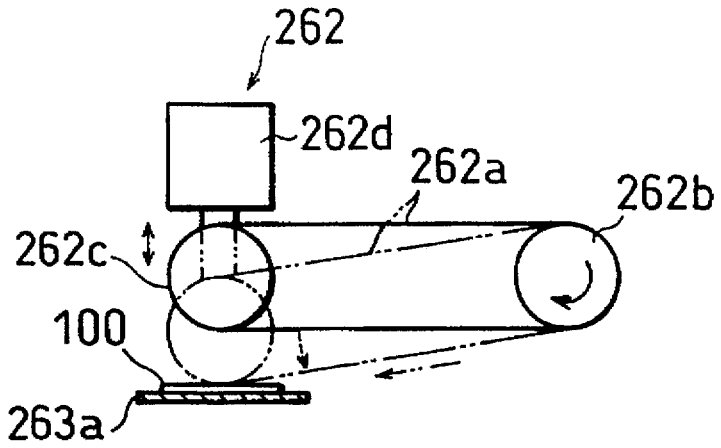
FIG. 16 is a magnified front view of a second defective body collecting section of FIG. 12.

The defective body removing unit 262 is provided between the upper-forward transportation belt unit 264 and upper-aft transportation belt unit 265 on the lower transportation belt 263. As shown in FIG. 16, the defective body removing unit 262 includes a belt 262*a*, supporting rollers 262*b* and 262*c*, and a belt elevating unit 262*d*.

The belt 262*a* is provided in such a manner to intersect at right angles with the direction in which the sheet wrapping bodies 100 are transported by the lower transportation belt unit 263. The supporting roller 262*b* is stationary, while the other supporting roller 262*c* is driven by the belt elevating unit 262*d* and moves between an waiting position indicated by a solid line and an operating position indicated by a chain double-dotted line where the belt 262*a* touches the sheet wrapping body 100. When the supporting roller 262*c* moves to the operating position while the belt 262*a* is rotating, the sheet wrapping body 100 on the belt 263*a* is spun off from the belt 263*a* by the belt 262*a* in the direction indicated by an arrow. The sheet wrapping body 100 thus removed is thrown into a collecting box 266 shown in FIG. 11. Note that it does not matter either of the supporting roller 262*b* or 262*c* serves as the driving force.

The operation of the belt elevating unit 262*d* is controlled by the control unit 217 shown in FIG. 13. To be more specific, when the image processing section 253 of the translucent defective body detecting section 213 judges a sheet wrapping body 100 is defective, the control unit 217 controls the belt elevating unit 262*d* to remove the defective sheet wrapping body 100. The control unit 217 computes a control timing based on a distance between the translucent defective body detecting section 213 and defective body removing unit 262, and the transportation speed of the sheet wrapping bodies 100.

The second transportation belt unit 231 may also include the defective body removing unit 262 instead of the mechanism comprising the aft belt units 239 and 241 and the cylinder 237.

The aligning and transporting section 215 includes the second half portion of the third transportation belt unit 261, namely, the upper-aft transportation belt unit 265 and the second half portion of the lower transportation belt 263, an alignment screw unit 271, a wrapping body's top supporting unit 272, and a quota transportation unit 273.

Figure 17:
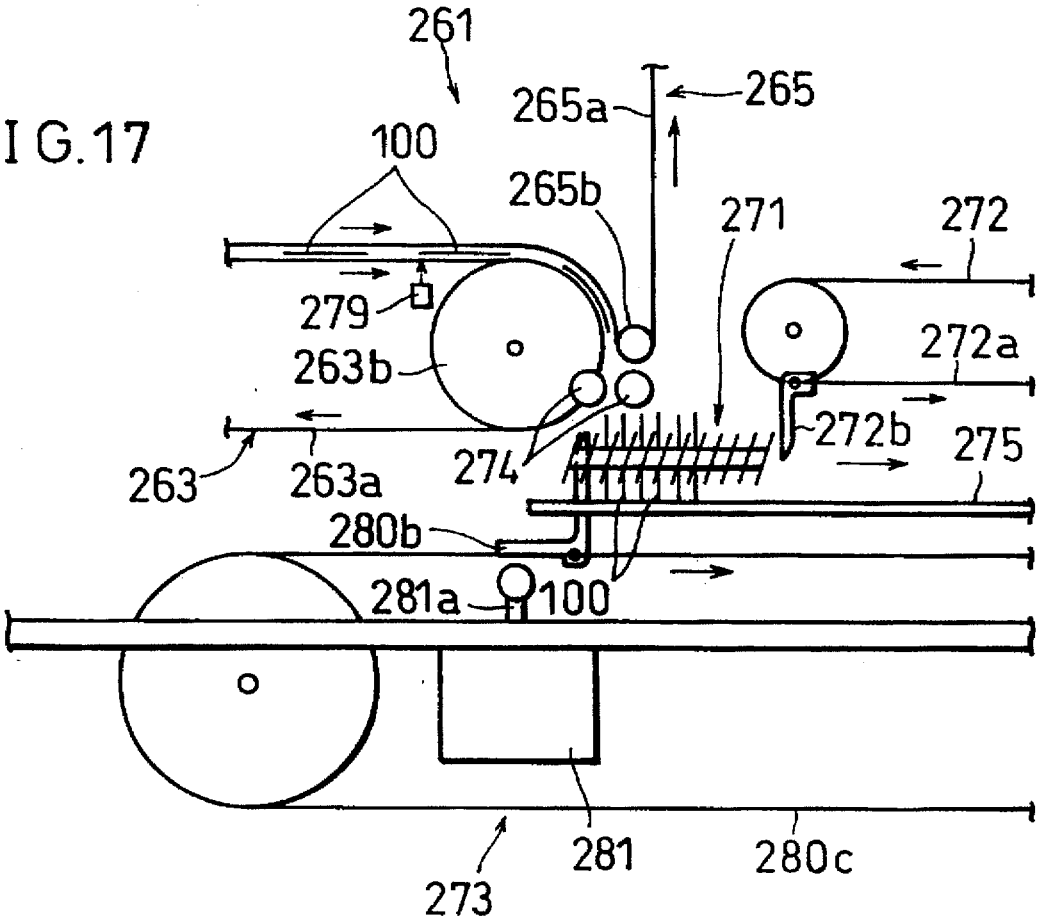
FIG. 17 is a magnified view around an alignment screw unit of FIG. 12.

As shown in FIG. 17, the supporting roller 265*b* in the second half portion of the upper-aft transportation belt unit 265 is placed near the back of the supporting roller 263*b* of the lower transportation belt unit 263. The axes of the supporting rollers 265*b* and 263*b* are substantially in the same level. The belt 265*a* of the upper-aft transportation belt unit 265 overlaps the belt 263*a* of the lower transportation unit 263 in a part of the outer surface of the supporting roller 263*b*. Thus, the sheet wrapping body 100 fastened by the belts 265*a* and 263*a* is transported downward at the bottom end portions of the upper-aft transportation belt unit 265 and lower transportation belt unit 263.

A pair of guide rollers 274 are provided under the supporting roller 265*b* for guiding the sheet wrapping body 100 further downward. The pair of guide rollers 274, lower transportation belt unit 263, and upper-aft transportation belt unit 265 form carrying means. The alignment screw unit 271 is provided below the pair of guide rollers 274. Therefore, the sheet wrapping body 100 is transported downward through a space between the pair of guide rollers 274 to the alignment screw unit 271 in upright position.

Figure 18:
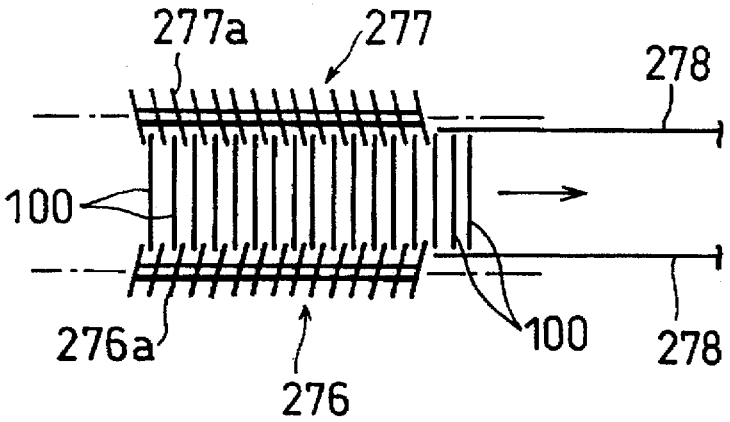
FIG. 18 is a plan view of the alignment screws of the alignment screw unit of FIG. 12.

The alignment screw unit 271 is placed on a lower guide plate 275. As shown in FIG. 18, the alignment screw unit 271 includes a pair of alignment screws 276 and 277 which respectively include a series of spiral blades portions 276*a* and 277*a*. Each screw is driven to rotate by an unillustrated driving mechanism. The sheet wrapping body 100 thrown into the alignment screw unit 271 is held between the alignment screws 276 and 277, and moves on the lower guide plate 275 in the direction indicated by an arrow as the alignment screws 276 and 277 rotate. More precisely, the two opposing sides of the sheet wrapping body 100 are held by the blades of the blade portions 276*a* and 277*a* placed before and after the sheet wrapping body 100 in the axial direction of the blades, respectively. After the sheet wrapping body 100 passed by the end portions of the alignment screws 276 and 277, the two opposing sides are respectively guided by side portion guides 278 shown in FIG. 18.

The sheet wrapping bodies 100 are sequentially transported on the lower guide plate 275 while the one at the head of those on the lower guide plate 275 is supported by the body's top end supporting unit 272 at the top end. As shown in FIG. 17, the body's top end supporting unit 272 includes, for example, a belt 272*a* moving in a direction in which the sheet wrapping bodies 100 are transported and a supporting member 272*b* attached to the belt 272*a*. The supporting member 272*b* can touch the top end of the sheet wrapping body 100 held upright on the lower guide plate 275. Also, the supporting member 272*b* moves in the transportation direction as the sheet wrapping bodies 100 are transported forward by the alignment screw unit 271. Accordingly, it has become possible to prevent the sheet wrapping bodies 100 from falling forward.

Figure 19:
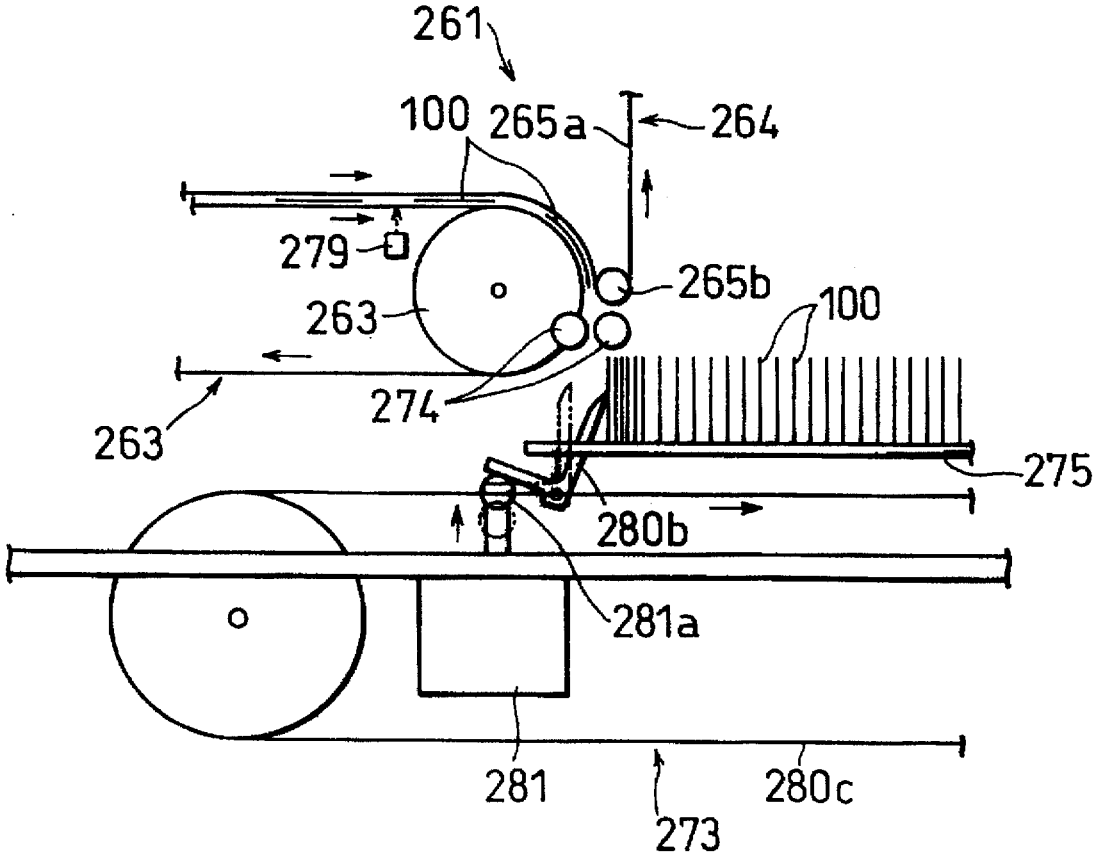
FIG. 19 is a view explaining an operation of a quota transportation unit of FIG. 18.

As shown in FIG. 12, the quota transportation unit 273 includes a wrapping body sensor 279, a transportation unit 280, and a partition member driving unit 281. The transportation unit 280 and partition member driving unit 281 form partition means. As shown in FIG. 19, the wrapping body sensor 279 detects each sheet wrapping body 100 passing over the lower transportation belt unit 263 to enable the control unit 217 to count the sheet wrapping bodies 100 transported to the alignment screw unit 271. Therefore, the wrapping body sensor 279 and control unit 217 form counting means.

As shown in FIG. 12, the transportation unit 280 includes, for example, a belt 280*c* moving in a direction in which the sheet wrapping bodies 100 are transported, and multiple pairs of head-end partition members 280*a* and bottom-end partition members 280*b* are provided on the belt 280*c*. More specifically, the pairs of the head-end partition members 280*a* and bottom-end partition members 280*b* are placed on the belt 280*c* at regular intervals in a direction in which the sheet wrapping bodies 100 are transported. The interval is determined by a thickness of a pile of the sheet wrapping bodies 100 contained in one box at the boxing unit 216.

The bottom-end partition members 280*b* can tilt as is shown in FIGS. 17 and 19. The head-end partition members 280*a* can tilt backward with respect to the direction in which they are headed, which is depicted by the head-end partition member 280*a* before the alignment screw unit 271 in FIG. 12. Each head-end partition member 280*a* tilts as is illustrated in FIG. 12 before it passes by the alignment screw unit 271, and returns to the original upright position afterward.

As shown in FIG. 19, the partition member driving unit 281 comprises, for example, a solenoid and includes a rod section 281 a moving back and forth. The rod section 281*a* pushes the bottom portion of the bottom-end partition member 280*b* upward when it moves forward, thereby turning the bottom-end partition member 280*b* as is illustrated in FIG. 19. The partition member driving unit 281 is under the control of the control unit 217 based on the detection of the wrapping body sensor 279. More specifically, the control unit 217 counts the number of the sheet wrapping bodies 100 thrown into the alignment screw unit 271 based on the detection of the wrapping body sensor 279. When the control unit 217 counts up to a predetermined number, or the number of the sheet wrapping bodies 100 packed in one box at the boxing section 216, the control unit 217 controls the partition member driving unit 281 to move the rod section 281*a* forward. Accordingly, the sheet wrapping bodies 100 are partitioned into groups by quota, or groups each having as many as sheet wrapping bodies 100 as those packed in one box. Note that the wrapping body's top supporting unit 272 and alignment screw unit 271 are omitted in FIG. 19.

The boxing unit 216 comprises the transportation unit 280 and a pusher 282 shown in FIG. 12. The pusher 282 moves in a direction intersecting at right angles with a direction in which the sheet wrapping bodies 100 are transported by the transportation unit 280. In other words, the pusher 282 pushes a group of the sheet wrapping bodies 100, partitioned by a pair of the head-end partition member 280*a* and bottom-end partition member 280*b*, into a box placed with its opening opposing the pusher 282 with the transportation unit 280 in between. The pusher 282 is also controlled by the control unit 217.

According to the above structure, the sheet wrapping bodies 100 cut out by the second rotary die cut unit 25 are transported to the first defective body collecting unit 212, and the used coating sheet after the cutting out step is collected by the used coating sheet cut and collect unit 211.

Of all the sheet wrapping bodies 100 having reached the first defective body collecting section 212, those judged as being defective by the control unit 217 based on the detection results of the color sensors 233*a*–233*d* and photoelectric sensors 234*a* and 234*b* are removed at this point. As shown in FIG. 14, the defective sheet wrapping bodies 100 are removed as the aft belt units 239 and 241 of the second transportation belt unit 231 turns to the collecting position.

The sheet wrapping bodies 100 having passed by the first defective body collecting section 212 are transported further to the translucent defective body detecting section 213 by the second transportation belt unit 231. As set forth in TABLE 1 above, the translucent defective body detecting section 213 measures the dimension of the product, namely, the sheet wrapping body 100, and the dimension of the oxygen absorbing sheet tip 30 inside thereof, and detects the presence of the oxygen absorbing sheet tip 30. The control unit 217 judges whether the sheet wrapping body 100 in question is defective or not based on the detection result, and those judged as being defective are removed at the second defective body collecting section 214.

In the translucent defective body detecting section 213, the sheet wrapping bodies 100 are transported afloat on the glass plate 254 by an airflow from the transportation blower 255. While each sheet wrapping body 100 passes by the glass plate 254, the light source 251 irradiates light onto the sheet wrapping body 100, and the camera section 252 picks up the image thereof.

The sheet wrapping bodies 100, having passed by the glass plate 254, are further transported under the defective body removing unit 262 by the lower transportation belt unit 263 and the upper-forward transportation belt unit 264 of the second defective body collecting unit 214. The sheet wrapping bodies 100 are transported by the lower transportation belt unit 263 alone under the defective body removing unit 262. When the sheet wrapping body 100 judged as being defective is transported under the defective body removing unit 262, the belt 262*a* thereof comes down onto the sheet wrapping body 100 from above and spins off the same from the transportation belt unit 263.

The sheet wrapping bodies 100 having passed by the defective body removing unit 262 are supplied to the alignment screw unit 271 of the aligning and transporting unit 215 by the lower transportation belt unit 263 and upper-aft transportation belt unit 265.

Then, the sheet wrapping bodies 100 are transported further downward while being fastened by the belts 263*a* and 265*a* at the end portions of the lower transportation belt unit 263 and upper-aft transportation belt 265, and thrown into a space between the pair of alignment screws 276 and 277 of the alignment screw unit 271 by being guided by the guide roller 274.

The sheet wrapping bodies 100 stand upright in the space between the alignment screws 276 and 277 as the both side portions are supported by the same, respectively. More specifically, one end portion of each sheet wrapping body 100 is placed between two spiral blades 276*a* of the alignment screw 276, while the other end portion is placed between two spiral blades 277*a* of the alignment screw 277. Thus, the sheet wrapping bodies 100 are transported toward the boxing section 216 as the alignment screws 276 and 277 rotate.

Two opposing sides of each sheet wrapping body 100 having passed by the end portion of the alignment screws 276 and 277 are guided by the side portion guides 278 shown in FIG. 18. Also, the top of a sheet wrapping body 100 at the head of those on the lower guide plate 275 is supported by the supporting member 272*b* of the body's top supporting unit 272. The supporting member 272*b* moves as the sheet wrapping bodies 100 move in the direction in which they are headed. As a result, the sheet wrapping bodies 100 are supported so as not to fall forward.

When the sheet wrapping bodies 100 are transported by the alignment screw unit 271, the head-end partition member 280*a* of the transportation unit 280 in the quota transportation unit 273 is situated ahead of the sheet wrapping bodies 100 in a direction in which they are transported. On the other hand, the bottom-end partition member 280*b* is situated around the top end of the alignment screws 276 and 277 placed in the lower stream with respect to the transportation direction.

The control unit 217 counts up the number of the sheet wrapping bodies 100 thrown into the alignment screw unit 271 based on the detection result of the wrapping body sensor 279. When the control unit 217 counts up to a predetermined number, for example, 300, the control unit 217 activates the partition member driving unit 281. Accordingly, as shown in FIG. 19, the bottom-end partition member 280*b* tilts toward the sheet wrapping bodies 100 thrown into the alignment screw unit 271. Thus, the sheet wrapping bodies 100 thrown into the alignment screw unit 271 after the bottom-end partition member 280*b* has tilted are thrown behind the bottom-end partition member 280*b*. As a result, exactly 300 of the sheet wrapping bodies 100 are held between one pair of head-end partition member 280*a* and bottom-end partition member 280*b*.

After the bottom-end partition member 280*b* has tilted, the pair of the head-end partition member 280*a* and bottom-end partition member 280*b* moves forward as the belt 280*c* moves from the side of the alignment screw 271 of FIG. 12 and stops at a position between the alignment screw unit 271 and pusher 282. This means that the belt 280*c*, namely, the transportation unit 280, operates intermittently.

While the transportation unit 280 operates, another pair of the head-end partition member 280*a* and bottom-end partition member 280*b* following the above-mentioned pair moves to a predetermined position with respect to the alignment screw unit 271. As shown in FIG. 12, the head-end partition member 280*a* of the secondly mentioned pair tilts backward with respect to the transportation direction and passes by the alignment screws 271*a* and 271*b*, and returns to the original upright position afterwards.

Further, the firstly mentioned pair of the head-end partition member 280*a* and bottom-end partition member 280*b* placed between the alignment screw unit 271 and pusher 282 reach a position corresponding to the pusher 282 as shown in FIG. 12 as the transportation unit 280 rotates. Thus, as the pusher 282 operates, 300 of sheet wrapping bodies 100 aligned between the head-end partition member 280*a* and bottom-end partition member 280*b* are pushed into a box placed with its opening opposing the pusher 282, thereby packing the sheet wrapping bodies 100 into the box.

As has been explained, in the sheet wrapping body producing apparatus of the present embodiment, defective sheet wrapping bodies 100 are checked twice: by the color sensors 233*a*–233*c* and the photoelectric sensors 234*a* and 234*b*, and by the translucent defective body detecting section 213. Thus, the tasks of each defective body detecting section are reduced. For this reason, although the sheet wrapping body producing apparatus of the present embodiment operates at high speeds, the defective bodies are removed in a more secured manner.

In particular, one of the most important checking items, namely, the detection of the presence of the oxygen absorbing sheet tips 30 inside of the sheet wrapping body 100, is checked in advance by detecting the pitches between the oxygen absorbing sheet tips 30 by the color sensor 233*d*. Thus, the translucent defective body detecting section 213 can be less responsible for checking the presence of the oxygen absorbing sheet tips 30, but the checking as a whole is carried out in a more secured manner.

In addition, the sheet wrapping bodies 100 cut out by the second rotary die cut unit 25 are transported to the alignment screw unit 271 by the aligning and transporting section 215, and aligned upright so that the surfaces thereof oppose each other. This facilitates the alignment, and hence the packing of multiple sheet wrapping bodies 100.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A sheet wrapping body producing apparatus comprising:

a supply unit of a sheet material subject to wrapping;

a first cut unit;

a transportation unit;

a bottom coating material supply unit;

a top coating material supply unit;

a seal unit; and a second cut unit, wherein, said supply unit of a sheet material subject to wrapping supplies a strip of a sheet material subject to wrapping to said first cut unit;

said first cut unit cuts out sheet tips subject to wrapping from said strip of the sheet material subject to wrapping using a first pair of rotating roller, said transportation unit transports said sheet tips subject to wrapping made by said first cut unit onto a bottom coating material while holding each said sheet tip subject to wrapping not to cause misalignment, said bottom coating material supply unit supplies a strip of said bottom coating material onto a transportation surface of said transportation unit, and transports said bottom coating material to a farther position by way of said seal unit and said second cut unit, said top coating material supply unit supplies a strip of a top coating material onto said sheet tips subject to wrapping placed on said bottom coating material, and transports said top coating material to a farther position by way of said seal unit and said second cut unit, said seal unit is provided in a stage following said transportation unit, and seals said top coating material and said bottom coating material to wrap up said sheet tips subject to wrapping individually using a second pair of rotating rollers, and said second cut unit cuts said top coating material and said bottom coating material in a sealed portion made by said seal unit using a third pair of rotating rollers, and produces sheet wrapping bodies each respectively wrapping the sheet tip subject to wrapping;

wherein, said transportation unit comprises an upper transportation unit and a lower unit, said upper transportation unit and said lower transportation unit opposing each other vertically to enable fastening of said sheet tips subject to wrapping, said upper and lower transportation units each comprises an upstream end portion and a downstream end portion with respect to a direction in which said sheet tips subject to wrapping are transported, said downstream end portion of said lower transportation unit extending farther in the direction in which said sheet tips subject to wrapping are transported compared with said downstream end portion of said upper transportation unit;

said bottom coating material supply unit supplies a strip of said bottom coating material onto a transportation surface of said lower transportation unit;

said top coating material supply unit includes a guide roller for guiding said top coating material onto said sheet tips subject to wrapping placed on said lower transportation unit, said roller being provided above said lower transportation unit at a position downstream in respect to said downstream end portion of said upper transportation unit, said guide roller, together with said lower transportation unit, transporting said sheet tips subject to wrapping while fastening said sheet tips subject to wrapping, said guide roller being provided at a position enabling fastening of a top end portion of each said sheet tip subject to wrapping with said lower transportation unit while a bottom end portion thereof is fastened by said lower transportation unit and said upper transportation unit.

2. The sheet wrapping body producing apparatus as defined in claim 1, wherein:

one of said first pair of rotating rollers of said first cut unit is a first attracting roller, said first attracting roller being rotatable while attracting said sheet tips subject to wrapping; and said transportation unit includes a second attracting roller opposing said first attracting roller, whereby said sheet tips subject to wrapping are delivered from said first attracting roller to said second attracting roller and transported forward through attraction.

3. The sheet wrapping body producing apparatus as defined in claim 2, wherein said first attracting roller includes separate holes of suction sections along a circumference of said first attracting roller for attracting said sheet tips subject to wrapping, said suction sections having their respective openings on an outer surface of said first attracting roller, a negative pressure being supplied only to some of said suction sections having moved into a range where said sheet tips subject to wrapping are attracted.

4. The sheet wrapping body producing apparatus as defined in claim 3, wherein a positive pressure is supplied only to at least one of said suction sections having moved to a range where said sheet tips subject to wrapping are delivered to said second attracting roller.

5. The sheet wrapping body producing apparatus as defined in claim 2, wherein said second attracting roller includes separate holes of suction sections along a circumference of said second attracting roller for attracting said sheet tips subject to wrapping, said suction sections having their respective openings on an outer surface of said first attracting roller, a negative pressure being supplied only to some of said suction sections having moved into a range where the sheet tips subject to wrapping are attracted.

6. The sheet wrapping body producing apparatus as defined in claim 2, wherein said first attracting roller and said second attracting roller rotate at different peripheral speeds, whereby said sheet tips subject to wrapping are transported forward at regular intervals.

7. The sheet wrapping body producing apparatus as defined in claim 2, wherein:

said transportation unit includes, at a stage following said second attracting roller, an upper transportation belt unit and a lower transportation belt unit, said upper transportation belt unit and said lower transportation belt unit opposing each other vertically to enable fastening of said sheet tips subject to wrapping;

said bottom coating material is supplied onto a transportation surface of said lower transportation belt unit;

an outer surface of said second attracting roller is smaller than each said sheet tip subject to wrapping in width, the outer surface opposing said lower transportation belt unit; and said upper transportation belt unit includes at least one belt along each of two opposing side surfaces of said second attracting roller, an interval of said belts being smaller than each said sheet tip subject to wrapping in width.

8. A sheet wrapping body producing apparatus comprising:

a supply unit of a sheet material subject to wrapping;

a first cut unit including a first attracting roller;

a second attracting roller;

a transportation unit;

a bottom coating material supply unit;

a top coating material supply unit;

a seal unit; and a second cut unit, wherein, said supply unit of a sheet material subject to wrapping supplies a strip of a sheet material subject to wrapping to said first cut unit, said first cut unit cuts out sheet tips subject to wrapping from said sheet material subject to wrapping using a first pair of rotating roller in a direction in which said first pair of rotating rollers rotate without leaving any unwanted space between two adjacent sheet tips subject to wrapping, one of said first pair of rotating rollers serving as said first attracting roller capable of rotating while attracting said sheet tips subject to wrapping, said second attracting roller is placed to oppose said first attracting roller, said second attracting roller transporting said sheet tips subject to wrapping delivered from said first attracting roller to said transportation unit through attraction, said first attracting roller and said second attracting roller rotating at different peripheral speeds, whereby two adjacent sheet tips subject to wrapping have a space as wide as a sealed portion made by said seal unit, said transportation unit transports said sheet tips subject to wrapping delivered from said second attracting roller further toward said seal unit while holding each said sheet tip subject to wrapping not to cause misalignment, said bottom coating material supply unit supplies a strip of a bottom coating material onto a transportation surface of said transportation unit, and transports said bottom coating material to a farther position by way of said seal unit and said second cut unit, said top coating material supply unit supplies a strip of a top coating material onto said sheet tips subject to wrapping placed on said bottom coating material, and transports said top coating material to a farther position by way of said seal unit and said second cut unit, said seal unit is provided at a lower stream with respect to a direction in which said sheet tips subject to wrapping are transported by said transportation unit, and seals said top coating material and said bottom coating material to wrap up said sheet tips subject to wrapping individually using a second pair of rotating rollers, and said second cut unit cuts said top coating material and said bottom coating material in the sealed portion made by said seal unit using a third pair of rotating rollers to produce sheet wrapping bodies each respectively wrapping the sheet tip subject to wrapping.

* * * * *